US008788364B1

(12) United States Patent
Milgrom et al.

(10) Patent No.: US 8,788,364 B1
(45) Date of Patent: Jul. 22, 2014

(54) SYSTEM FOR CONFIGURATION AND IMPLEMENTATION OF AN ASSIGNMENT AUCTION OR EXCHANGE

(75) Inventors: Paul R. Milgrom, Stanford, CA (US); Steve Goldband, Palo Alto, CA (US)

(73) Assignee: Auctionomics, Inc., Palo Alto, CA (US)

( * ) Notice: Subject to any disclaimer, the term of this patent is extended or adjusted under 35 U.S.C. 154(b) by 688 days.

(21) Appl. No.: 12/949,686

(22) Filed: Nov. 18, 2010

Related U.S. Application Data

(60) Provisional application No. 61/262,462, filed on Nov. 18, 2009.

(51) Int. Cl.
*G06Q 30/00* (2012.01)

(52) U.S. Cl.
USPC ..... 705/26.3; 705/14.71; 705/26.4

(58) Field of Classification Search
USPC ..... 705/31, 14.71, 26.3, 26.4
See application file for complete search history.

(56) References Cited

U.S. PATENT DOCUMENTS

| | | | | |
|---|---|---|---|---|
| 6,718,312 | B1 * | 4/2004 | McAfee et al. | 705/37 |
| 7,133,841 | B1 * | 11/2006 | Wurman et al. | 705/37 |
| 7,165,046 | B2 | 1/2007 | Ausubel | |
| 7,177,832 | B1 * | 2/2007 | Semret et al. | 705/37 |
| 7,461,022 | B1 * | 12/2008 | Churchill et al. | 705/37 |
| 8,271,345 | B1 * | 9/2012 | Milgrom et al. | 705/26.1 |
| 8,527,353 | B2 | 9/2013 | Lahaie et al. | |
| 2002/0013757 | A1 * | 1/2002 | Bykowsky et al. | 705/37 |
| 2002/0049642 | A1 * | 4/2002 | Moderegger et al. | 705/26 |
| 2004/0054551 | A1 * | 3/2004 | Ausubel et al. | 705/1 |
| 2006/0224496 | A1 * | 10/2006 | Sandholm et al. | 705/37 |
| 2007/0192201 | A1 * | 8/2007 | Nalik | 705/26 |
| 2008/0140493 | A1 * | 6/2008 | DeAngelis | 705/8 |

OTHER PUBLICATIONS

Assignment Messages and Exchanges, Paul Milgrom, American Economic Journal: Microeconomics 2009, 1:2, 95-113.*

Ausubel, Lawrence M., "An Efficient Ascending-Bid Auction for Multiple Objects," American Economic Review, 2004, pp. 1452-1475, vol. 94, No. 5.

Ausubel, Lawrence M. et al, "Auctioning Many Divisible Goods," Journal of the European Economic Association, 2004, pp. 480-493, vol. 2, Nos. 2-3.

Ausubel Lawrence M. et al, "Ascending Auctions with Package Bidding," Frontiers of Theoretical Economics, 2002, vol. 1, No. 1: Article 1.

Ausubel, Lawrence M. et al, 2006. "The Lovely but Lonely Vickrey Auction," Combinatorial Auctions, 2006, pp. 17-40, ed. Peter Cramton, Yoav Shoham, and Richard Steinberg, Cambridge, MA: MIT Press.

(Continued)

*Primary Examiner* — Seye Iwarere
(74) *Attorney, Agent, or Firm* — Patent Law Works LLP

(57) ABSTRACT

A system and method for configuring and executing an assignment exchange or auction with extensions to allocate items among bidders is disclosed. A server initializes the assignment auction or exchange and receives bid messages from one or more bidder devices, each bidder device associated with a bidder. Bidder devices may also communicate one or more constraints to the server to affect the allocation of items among bidders by the server. Additionally, the server includes bidder configuration data modifying the presentation of auction or exchange data to different bidders, allowing different bidders to receive different amounts of information regarding the auction or exchange. The bidder configuration data also allows the server to enable or restrict the types of bid messages different bidders may communicate to the server.

33 Claims, 13 Drawing Sheets

(56) References Cited

OTHER PUBLICATIONS

Budish, Eric et al., "Implementing Random Assignments: A Generalization of the Birkhoff-Von Neumann Theorem." 2008, Unpublished.
Compte, Olivier et al., "On the Virtues of the Ascending Price Auction: New Insights in the Private Value Setting," Sep. 2000, 25 pages.
Cramton, Peter et al., Combinatorial Auctions, 2006, 1179 pages, Cambridge, MA: MIT Press.
Crawford, Vincent P., "The Flexible-Salary Match: A Proposal to Increase the Salary Flexibility of the National Resident Matching Program.," Journal of Economic Behavior & Organization, 2008, pp. 149-160, vol. 66, No. 2.
Gale, David, "The Theory of Linear Economic Models," 1960, Chicago, IL: University of Chicago Press.
Gul, Faruk et al., "Walrasian Equilibrium with Gross Substitutes," Journal of Economic Theory, 1999, pp. 95-124, vol. 87 No. 1.
Gul, Faruk et al., "The English Auction with Differentiated Commodities," Journal of Economic Theory, 1999, 25 pages vol. 92, No. 1.
Hatfield, John William et al., "Matching with Contracts," American Economic Review, 2005, pp. 943-935, vol. 95 No. 4.
Heller, I. et al., "An Extension of a Theorem of Dantzig's," Linear Inequalities and Related Systems, 1956, pp. 247-254, ed. Harold William Kuhn and Albert William Tucker, Princeton, NJ: Princeton University Press.
Kelso, Alexander S., Jr., et al., "Job Matching, Coalition Formation, and Gross Substitutes," 1982, pp. 1486-1504, Econometrica, vol. 50, No. 6.
Klemperer, Paul D.,"A New Auction for Substitutes: Central Bank Liquidity Auctions, the U.S. TARP, and Variable Product-Mix Auctions," 2008, 17 pages.
Kremer, Ilan et al., "Divisible-Good Auctions: The Role of Allocation Rules," 2004 RAND Journal of Economics, pp. 147-159, vol. 35, No. 1.
McAdams, David, "Modifying the Uniform-Price Auction to Eliminate 'Collusive-Seeming Equilibria,'" Feb. 25, 2002, 38 pages.
Milgrom, Paul, "Assignment Messages and Exchanges," American Economic Journal: Microeconomics 2009, pp. 95-113, vol. 1, No. 2.
Milgrom, Paul, "Simplified Mechanisms with an Application to Sponsored-Search Auctions," Games and Economic Behavior, Sep. 2010, pp. 62-70, vol. 70, No. 1.
Milgrom, Paul, "Putting Auction Theory to Work: The Simultaneous Ascending Auction," Journal of Political Economy, 2002, pp. 245-272, vol. 108, No. 2.
Milgrom, Paul, "Putting Auction Theory to Work," Jan. 12, 2004, 396 pages, Cambridge, MA: Cambridge University Press.
Milgrom, Paul, "Package Auctions and Exchanges," Econometrica, Jul. 2007, pp. 935-965, vol. 75, No. 4.
Milgrom, Paul et al., "Substitute Goods, Auctions, and Equilibrium," Journal of Economic Theory, Apr. 22, 2008, pp. 212-247, vol. 144, No. 1.
Nisan, Noam, "Bidding Languages for Combinatorial Auctions," Combinatorial Auctions, 2006, Cambridge, MA, 19 pages.
Rezende, Leonardo, "Mid-Auction Information Acquisition," Aug. 31, 2005, 35 pages.
Shapley, Lloyd S. et al., "The Assignment Game I: The Core," International Journal of Game Theory, 1971, pp. 111-130, vol. 1, No. 1.
Topkis, Donald M., "Minimizing a Submodular Function on a Lattice," Operations Research, 1978, pp. 035-21, vol. 26, No. 2.
Wilson, Robert B., "Auctions of Shares," Quarterly Journal of Economics, Nov. 1979, pp. 675-689, vol. 93 No. 4.

* cited by examiner

SYSTEM FOR CONFIGURATION AND IMPLEMENTATION OF AN ASSIGNMENT AUCTION OR EXCHANGE

CROSS REFERENCE TO RELATED APPLICATIONS

The present application claims the benefit of priority under 35 U.S.C. §119(e) of U.S. Provisional Application No. 61/262,462, entitled "MaaX Assignment Auction and Exchange System," filed on Nov. 18, 2009, which is hereby incorporated by reference in its entirety.

BACKGROUND OF THE INVENTION

1. Field of the Invention

The present invention generally relates to on-line systems and methods for the exchange or allocation of goods or services, and more specifically relates to systems and methods for on-line multi-product, sealed-bid auction and exchange markets.

2. Description of the Related Art

The problem of communication complexity is endemic to trade and resource allocation: any mechanism that promotes gains from trade must elicit sufficient information from participants in order to identify which participants want different items. Reducing the complexity of the information elicited for efficient exchange is among the most important practical problems facing mechanism designers. For example, in the National Resident Matching Program (NRMP), which places doctors into hospital residency programs, for a hospital that interviews fifty candidates in the hopes of employing ten to report its preferences fully, the hospital needs to rank, from most-preferred to-least-preferred, not simply all fifty candidates, but rather all possible subsets of ten or fewer doctors from among the fifty. Such a rank-order list would have approximately $1.3\times10^{10}$ entries! In the completed FCC auction 73, which sold 1090 radio spectrum licenses, a value report for all non-empty collections of licenses is a vector of dimension $2^{1090}-1\approx1.3\times10^{328}$. These examples illustrate the lengthy report problem which, for moderate sized applications, renders useless any mechanism requiring full, unstructured reporting of preferences.

There are two conventional approaches to mitigating the lengthy report problem. The first approach simplifies the set of reports to reduce the reporting burden on participants. For example, hospitals in the NRMP report rank order lists of individual candidates together with a number of available positions, rather than lists of sets of candidates. In the example from the preceding paragraph, a list of candidates has a length of only fifty, which is practically manageable, and the NRMP algorithm imputes preferences over sets of candidates to make use of the limited reports. This simplification has performed well enough to be used for a long period of years, partly because it satisfies the important fidelity principle that a simplification should represent actual preferences to a good approximation in a large set of realistic cases. Nevertheless, Internet discussion groups detailing annoying limitations of the NRMP underscore its restrictions on preference reporting.

In mechanism design theory, the term "simplification" refers to a mechanism that is obtained from some original "extended" mechanism by restricting the reports available to participants. In a simplification, it is possible that for some preferences, some profiles of reports that were not Nash equilibria of the original unrestricted mechanism can be Nash equilibria of the simplified mechanism. These additional equilibria may have very different properties from the equilibria of the original mechanism, fundamentally changing the character of the mechanism of the simplification. A simplification is tight if, for a wide set of specifications of preferences of the mechanism participants, all the pure Nash equilibria of the new mechanism are Nash equilibria of the original mechanism. Tightness is an important property of a simplified mechanism because it guarantees that the simplification preserves some key properties of the original mechanism, regardless of the preferences of the participants.

The second pure approach to the lengthy report problem employs a dynamic mechanism with staged reporting of information. Such mechanisms economize reporting by only asking for partial information, which may depend on what has been learned in earlier stages of reporting. Ascending and descending multi-product auctions are dynamic mechanisms of this sort which have been popular for commercial applications. These are typically applied when similar but distinct goods are being sold, such as radio spectrum licenses to use different but nearby frequencies, commodities available at different locations or times, commodities available in different grades or with different amounts of processing or commodities subject to different delivery guarantees or contract terms. When goods are substitutes, modern simultaneous ascending or descending auctions—in which various goods are sold in auctions that take place simultaneously and are linked by so-called "activity rules"—are theoretically well-suited to finding stable allocations or competitive prices. During such auctions, bidders learn about market conditions before making their final bids, which may improve the final allocation compared to the simplest sealed-bid mechanisms.

However, dynamic auctions have important drawbacks. The dynamic auctions that perform well according to economic theory require bidders to make very many bids as prices gradually change, leading to long, slow-running auctions that take many hours, days, weeks or even months to reach a conclusion. Such slow auctions are costly for participants and unworkable for spot markets, such as the hour-ahead markets for electricity, where only minutes are available to find clearing prices. For export applications, finding a convenient hour for real-time bidding by participants living in different time zones can be almost impossible. Moreover, because real auctions cannot use the infinitesimal price increments analyzed in theoretical models, actual dynamic auctions are essentially always inexact in finding market-clearing prices.

According to a theoretical result known as the revelation principle, it is possible to duplicate the outcome of any dynamic mechanism using a sealed-bid mechanism in which participants report preferences just once. The development of such an equivalent sealed-bid mechanism equivalent to the ascending or descending multi-product auction, however, has been blocked because suitably compact means of communicating preferences have not been developed. However, two special characteristics shared by many practical applications suggest the possibility of developing a language to communicate preferences efficiently for a set of important applications in which goods are substitutes.

First, when different versions of a good are substitutable at all for a particular user, the rate of substitution is frequently one-for-one or nearly one-for-one. For example, a cement purchaser may wish to buy some quantity of cement and may be prepared to pay more to a supplier located closer to the point of use while the quantity needed may still be fixed independently of the source; thus, the substitution is one-for one. As another example, a northern California electric utility may purchase power at the Oregon border or from southern California, subject to transmission constraints on each source. In yet another example, a cereal maker may be able to substitute bushels of grain today for bushels tomorrow by storing the grain in a suitable facility or by substituting one type of grain for another up to limits imposed by product specifications. The above examples are examples of substitution by buyers, but a similar structure for substitution is found among sellers, such as when a manufacturer can deliver several versions of the same processed good. In each case, substitution probabilities are typically limited, but when substitution is possible, the substitution typically involves approximately one-for-one substitution among various versions of a good. Because the substitution structure may apply to both buyers and sellers, the substitution structure can be exploited to create systems and methods for auctions-to-buy, auctions-to-sell and exchanges in which there may be both multiple bids to buy and multiple offers to sell.

A second feature for the practical implementation of many auction and exchange mechanisms is that buyers and sellers may frequently find it helpful or necessary to respect integer constraints. Many commodities are most efficiently shipped by the truckload or by the container-load, and even divisible resources such as electrical power may frequently be sold in whole numbers of megawatts. Even when integer constraints are not logically necessary, common practices many make them useful, so a practical resource allocation mechanism respects such integer constraints.

One of the current problems with existing sealed-bid trading mechanisms, including exchanges and auctions, is that in their efforts to simplify the bidding process, only very simple bids may be entered and simple rules applied, drastically limiting the ability of bids to communicate complex preferences. For certain types of transactions, more complex bids or rules may be valuable. A buyer able to meet its need in multiple ways and regarding alternative lots as substitutes benefits from an ability to link bids to make multiple bids and limit the number of bids filled to an adequate set of its bids. A trader who wishes to execute a "swap" transaction by buying one item and selling another, may find the transaction too risky unless it can link its bid-to-buy with its offer-to-sell, so that one is executed only if the other is executed as well. In conventional economic analysis, bids-to-buy and offers-to-sell are both particular instances of offers to trade or "bids," where the transaction quantities are understood to be positive for buyers and negative for sellers. Under this analysis, the prior two examples are both instances of linkages limiting the net or total volume in several transactions, where bids-to-buy represent positive quantities and bids-to-sell represent negative quantities.

An additional limitation to conventional systems is that systems that do allow complex bids—systems known as combinatorial auctions—determine only "package prices" and not market-clearing item prices for individual items to clear markets. This determination of package prices is because, in some exchange problems, market-clearing prices do not exist. However, individual item prices may be needed for many applications. For example, individual item prices provide a basis for allocation of sales revenue to multiple suppliers. It is possible to limit even complex bids so that market-clearing item prices exist.

Accordingly, the manner in which bides communicate with an auction system is important for the success of multi-product auctions, as bidder preferences, demands and supplies are often complex and difficult to describe using conventional, simple bid interfaces.

SUMMARY OF THE INVENTION

Embodiments of the present invention overcome the deficiencies of the prior art by providing a system to simplify configuration and implementation of an assignment exchange or auction. In one embodiment, the system comprises one or more bidder devices coupled to a server. The server receives item identifiers and bidder identifiers specifying items and bidders, respectively, included in an auction or exchange. A bidder uses a bidder device to transmit one or more bid messages to the server. In one embodiment, a bid messages includes a bidder identifier, an item identifier, a maximum quantity associated with the item identifier and a price associated with the item identifier. In another embodiment, a bid message includes one or more constraints associated with a bidder, such as limitations on the amount the bidder is permitted to spend or a limit on the number of items a bidder may be allocated. The server then determines prices associated with the items using one or more stored pricing rules and determines an allocation of items between bidders using the determined prices and accounting for constraints associated with a bidder, if any. In one embodiment, the server allocates items among bidders such that the total difference between the maximum prices of bids to buy an item and the minimum prices of bids to sell an item—the reported gains from trade—are maximized. After allocating items among bidders, the server communicates a message to one or more bidder devices to describe the results of an auction or exchange to one or more bidders.

In one embodiment, the server includes data modifying the content and format of the messages communicated to the one or more bidder devices, allowing different amounts of data to be transmitted to different bidder devices, customizing the data presented to a bidder. In another embodiment, the server transmits data describing a user interface to the one or more bidder devices, allowing the server to modify and specify the user interface used by bidders to transmit data to the server and to view data received from the server.

The features and advantages described herein are not all-inclusive and many additional features and advantages will be apparent to one of ordinary skill in the art in view of the figures and description. Moreover, it should be noted that the language used in the specification has been principally selected for readability and instructional purposes, and not to limit the scope of the inventive subject matter.

BRIEF DESCRIPTION OF THE DRAWINGS

The invention is illustrated by way of example, and not by way of limitation in the figures of the accompanying drawings in which like reference numerals are used to refer to similar elements.

DETAILED DESCRIPTION OF EMBODIMENTS

Figure 1:
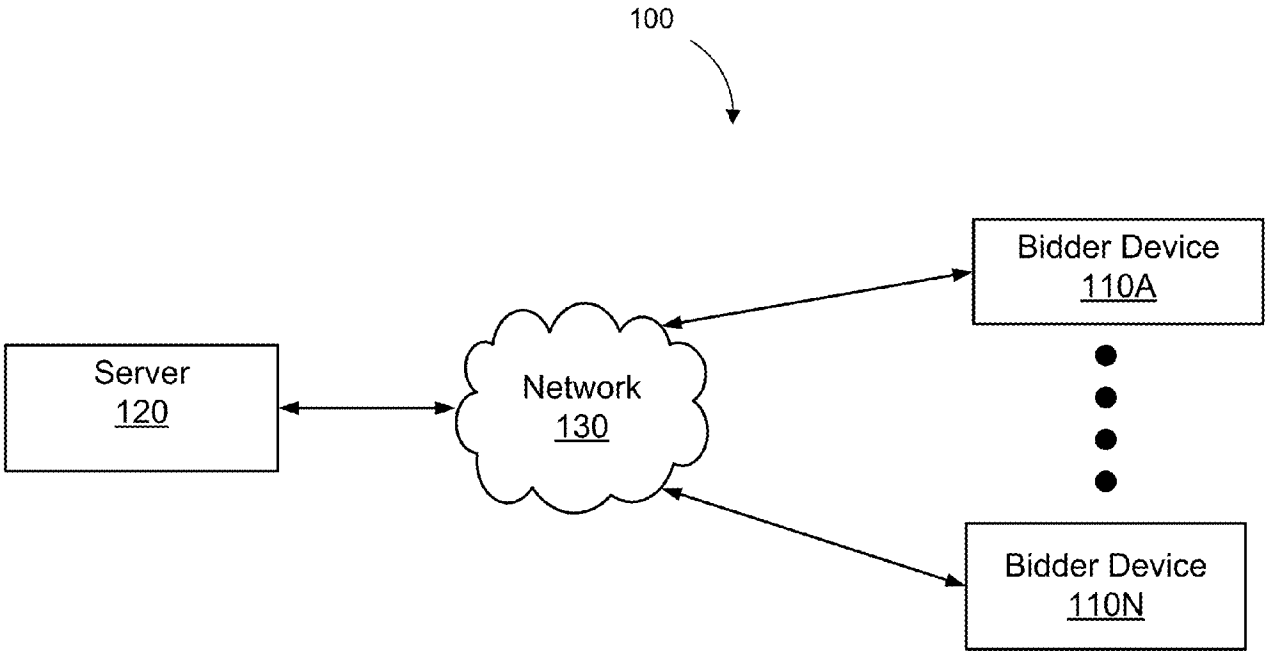
FIG. 1 is a block diagram of an assignment exchange and auction system in accordance with one embodiment of the present invention.

A system for an assignment exchange or auction is described. In the following description, for purposes of explanation, numerous specific details are set forth in order to provide a thorough understanding of the invention. It will be apparent, however, to one skilled in the art that the invention can be practiced without these specific details. Structures and devices are shown in block diagram form in order to avoid obscuring the invention. For example, the present invention is described in one embodiment below with reference to specific auctions or other allocations of items. However, the present invention applies to any type of computing system and/or data processing for implementing an exchange or auction.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the detailed descriptions that follow are presented in terms of algorithms and symbolic representations of operations on data bits within a computer memory. These algorithmic descriptions and representations are the techniques commonly used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared or otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus or available to the computer system over a network, such as the Internet, in a configuration known as "cloud computing."

The invention can take the form of an entirely hardware embodiment, an entirely software embodiment or an embodiment containing both hardware and software elements. In one embodiment, the invention is implemented in software comprising instructions or data stored on a computer-readable storage medium, which includes but is not limited to firmware, resident software, microcode or another method for storing instructions for execution by a processor.

Furthermore, the invention can take the form of a computer program product accessible from a computer-usable or computer-readable storage medium providing program code for use by, or in connection with, a computer or any instruction execution system. For the purposes of this description, a computer-usable or computer readable medium is any apparatus that can contain, store or transport the program for use by or in connection with the instruction execution system, apparatus or device.

The computer-readable storage medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Examples of optical disks include compact disk—read only memory (CD-ROM), compact disk—read/write (CD-R/W) and digital video disk (DVD).

A data processing system suitable for storing and/or executing program code includes at least one processor coupled directly or indirectly to memory elements through a system bus. The memory elements can include local memory employed during actual execution of the program code, bulk storage and cache memories providing temporary storage of at least some program code in order to reduce the number of times code must be retrieved from bulk storage during execution. In some embodiments, input/output (I/O) devices (such as keyboards, displays, pointing devices or other devices configured to receive data or to present data) can be coupled to the system either directly or through intervening I/O controllers.

Network adapters may also be coupled to the system to allow coupling of the data processing system to other data processing systems, remote printers or storage devices through intervening private or public networks. Modems, cable modem and Ethernet cards are example types of network adapters.

Finally, the algorithms and displays presented herein are not inherently related to any particular computer or other apparatus. Various general-purpose systems may be used with programs in accordance with the teachings herein, or it may prove convenient to construct more specialized apparatuses to perform the required method steps. The required structure for a variety of these systems will appear from the description below. In addition, the present invention is described without reference to any particular programming language. It will be appreciated that a variety of programming languages may be used to implement the teachings of the invention as described herein.

System Overview

The present invention provides a system for running multi-product, sealed bid auction and exchange markets, also referred to as an "assignment exchange and auction" system 100. The assignment exchange and auction system 100 allows assignment, allocation and pricing of multiple items among bidders. As referred to herein, an item is a good, a service or any other entity that offered for sale or purchase. In one embodiment, an item is associated with an item identifier, such as a name, and a unit definition describing a quantity of the item to be purchased or sold. For example, a bidder, or another user of the assignment exchange and auction system 100 associates a name with an item for sale and also specifies a unit definition indicating a minimum quantity of an item available for purchase in a bid. As referred to herein, a "bidder" is an entity with access to the assignment exchange and auction system 100. Although a bidder is commonly an entity that places bids to buy or sell an item, as used herein, a "bidder" also identifies any entity able to access the assignment exchange and auction system 100, such as an entity having a login and password associated with the assignment exchange and auction system 100.

In many practical applications, the direct mechanisms studied in much of economic theory are far too complex to be useful, so simplification is at the core of much of practical market design for auctions. The assignment exchange and auction provides a simplified method for assigning and/or pricing multiple goods or items in scenarios where there are a certain number of varieties of a good that are offered for sale or where there are a certain number of items to be allocated among different bidders or entities.

The assignment exchange and auction system 100 also allows substitution of and among items. When different versions of a good are substitutable, the rate of substitution is frequently one-for-one, or nearly one-for-one. For example, a cement purchaser buying some quantity of cement may be prepared to pay more to a supplier located closer to the point of use, while keeping the quantity of cement purchased fixed independently of the source, making the substitution of cement from different suppliers one-for-one. As another example, a northern California electric utility may purchase power at the Oregon border or from southern California, subject to transmission constraints on each. In yet another example, a cereal maker may be able to substitute bushels of grain today for bushels tomorrow by storing the grain in a suitable facility or be able to substitute one type of grain for another up to limits imposed by product specifications. While the above provide examples of substitution by byers, a similar substitution structure is possible for sellers. For example, a seller may substitute between different versions of goods when a manufacturer is able to deliver several versions of the same processed good.

However, in certain markets, items have rates of substitution other than one-to-one. For example, if there is transmission loss in the delivery of electric power, but items are purchased at the source, a bidder needing a certain amount of delivered power may differently discount power from different sources that have different transmission losses as sources with higher transmission losses are less effective in satisfying demand. To account for different rates of substitution, the assignment exchange and auction system 100 allows bidders to specify an effectiveness coefficient describing how effectively an item satisfies demand. Thus, the rate of substitution between two items is the ratio of the relative effectiveness associated with the items. For example, two units of power associated with an effectiveness coefficient of 0.5 are needed to replace one unit of power associated with an effectiveness coefficient of 1.0. In one embodiment, the assignment and exchange system 100 associates an effectiveness coefficient of 1.0 with items unless a bidder specifies a different effectiveness coefficient.

Substitution of items combined with integer demands and/or supplies, enables the assignment exchange and auction system 100 to provide an efficient integer allocation of items. The assignment exchange and auction system 100 beneficially takes advantage of substitutions when available and outputs integer allocations. Even when integer constraints are not logically necessary, common practice often makes integer constraints useful as many commodities are most efficiently shipped by the truckload or container-load, and even divisible resources such as electrical power may readily be sold in whole numbers of megawatts. Therefore, a practical resource allocation, such as the assignment exchange and allocation system 100 mechanism respects integer constraints.

FIG. 1 shows an embodiment of an assignment exchange and auction system 100. The embodiment shown by FIG. 1 comprises one or more bidder devices 110A 110N (also referred to individually and collectively as 110), a server 120 and a network 130. However, in other embodiments, the assignment exchange and auction system 100 may include different and/or additional components than those depicted by FIG. 1.

The one or more bidder devices 110A, 110N comprise computing devices having data processing and data communication capabilities. For example, a bidder device 110 comprises a desktop computer, a laptop computer, a netbook computer, a tablet computer or a smartphone. In one embodiment, different bidder devices 110A, 110N comprise different types of computing devices. A bidder device 110 receives data from a bidder and communicates the data to the server 120 via the network 130 using wireless and/or wireless communication techniques. Additionally, a bidder device 110 receives data from the server 130 via the network 130 and presents the data to a bidder using an output device. In one embodiment, the bidder device 110 receives data or instructions from the server 120 describing display of a user interface to a bidder and a processor included in the bidder device 110 executes the data or instructions to display the user interface. Examples of user interfaces for receiving data from a bidder and/or presenting data to a bidder are further described below in conjunction with FIGS. 4-13. For example, the bidder device 110 receives data from a bidder via an input device, such as a keyboard, a touch-screen or a mouse, describing a bid for an item by a bidder and uses a network controller to transmit the bid to the server 120 via the network 130. As another example, the bidder device 110 receives data describing an auction, such as a schedule and prices associated with items from the server 120 and presents the product prices and/or round schedule to a bidder using one or more output devices, such as a display device and/or an audio playback device.

The server 120 comprises a computing device coupled to the network 130 via one or more wired communication protocols, one or more wireless communication protocols or a combination of wireless and wired communication protocols. The server 120 initializes an auction or exchange. For example, the server 120 receives data from a user, such as an auctioneer, identifying bidders participating in the auction, items available in the auction, privileges associated with bidders participating in the auction or other data used to describe the participation in an auction or exchange and/or operation of the auction or exchange. After initializing the auction or exchange, the server 120 receives bids from one or more bidder devices 110A, 110N via the network 130 and determines the pricing and allocation of items among bidders based on the received bids. In one embodiment, one or more constraints or rules are also used by the server 120 when allocating items among bidders. The constraints or rules are further described below in conjunction with FIG. 2 and may be received from one or more bidder devices 110 or specified by a bidder during initialization of the auction or exchange. After allocating items among bidders, the server reports the results of the auction or exchange to one or more bidders by transmitting messages to one or more bidder devices 110 via the network 130. The server 120 is further described below in conjunction with FIG. 2, while the functionality of the server 120 is further described below in conjunction with FIG. 3.

In one embodiment, one or more bidder devices 110 transmit a bid to the server 120 via the network 130 using a bid message. For example, a bid message includes a bidder identifier associated with the bidder transmitting the message, an item identifier specifying the item on which the bidder is bidding, a maximum quantity specifying a maximum amount of the identified item and a price the bidder is offering for the identified item. If the bidder is a buyer, the price included in the bid message represents the bidder's maximum price for buying, while if the bidder is a seller the price included in the bid message represents the bidder's minimum or reserve price. In other embodiments, a bid message may include different and/or additional data, such as a bid type identifier specifying whether a bid is a bid to buy or a bid to sell. For example, a bid message may include an effectiveness coefficient describing how effectively an item satisfies a bidder's demand, affecting the substitution of a first item for a second item during an auction or exchange. Additional examples of bid messages are described in U.S. patent application Ser. No. 12/340,999. Other types of messages, further described below in conjunction with FIG. 2, may also be transmitted between a bidder device 110 and the server 120 via the network 130.

The network 130 is a conventional network and may have any number of configurations such as a star configuration, a token ring configuration or another configuration known to those skilled in the art. In various embodiments, the network 130 comprises a wireless network, a wired network or a combination of a wireless and a wired network. Furthermore, the network 130 may comprise a local area network (LAN), a wide area network (WAN) (e.g., the Internet), and/or any other interconnected data path across which multiple devices may communicate. In yet another embodiment, the network 130 may be a peer-to-peer network. The network 130 may also be coupled to, or include, portions of a telecommunications network for communicating data using a variety of different communication protocols. In yet another embodiment, the network 130 includes Bluetooth communication networks or a cellular communications network for sending and receiving data. For example, the network 130 transmits and/or receives data using one or more communication protocols such short messaging service (SMS), multimedia messaging service (MMS), hypertext transfer protocol (HTTP), direct data connection, WAP, email or another suitable communication protocol.

Figure 2:
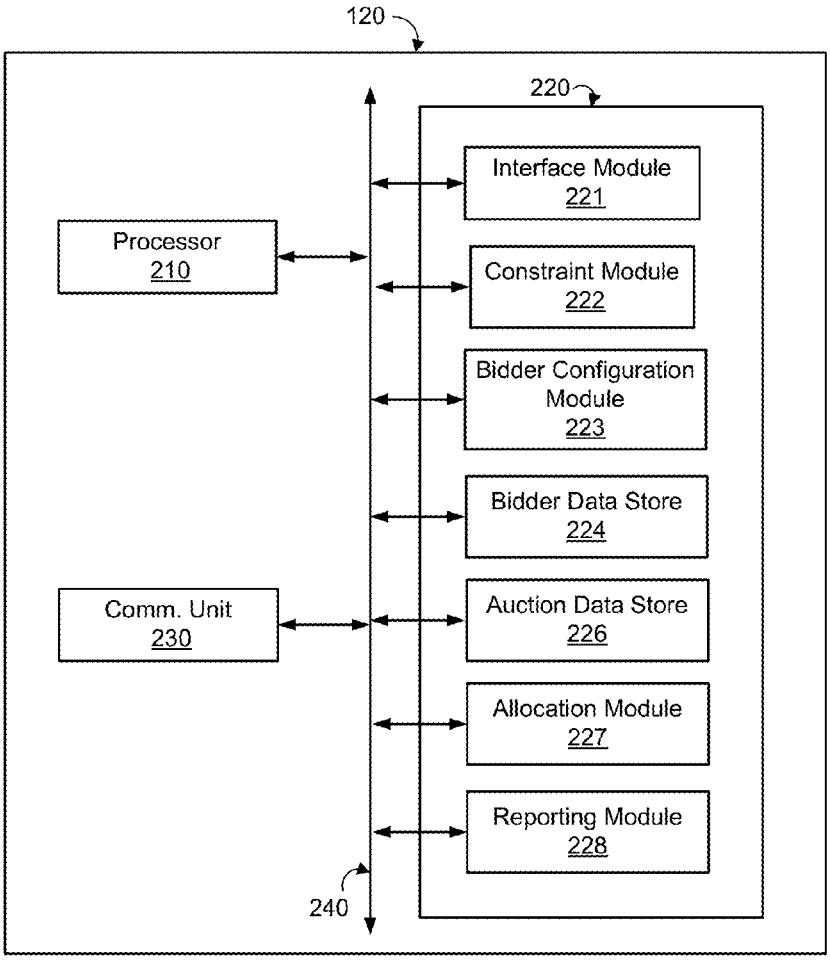
FIG. 2 is a block diagram of one embodiment of a server for implementing an assignment exchange or auction in accordance with the present invention.

FIG. 2 shows one embodiment of a server 120 for implementing an assignment auction or exchange in accordance with an embodiment of the present invention. In the embodiment depicted by FIG. 2, the server 120 comprises a processor 210, a storage device 220 and a communication unit 230 coupled to each other via a bus 240. However, in other embodiments the server 120 may include different and/or additional components than the ones shown by FIG. 2.

The processor 210 comprises an arithmetic logic unit, a microprocessor, a general purpose controller or some other processor array to perform computations or other data processing. The processor 210 is coupled to the bus 240 for communication with the other components of the server 130. Processor 210 processes data signals and may comprise various computing architectures including a complex instruction set computer (CISC) architecture, a reduced instruction set computer (RISC) architecture or an architecture implementing a combination of instruction sets. Although only a single processor 210 is shown in FIG. 2, in other embodiments the server 120 may include multiple processors.

The storage device 220 stores instructions and/or data that may be executed by processor 210. The stored instructions and/or data may comprise code for performing any and/or all of the techniques described herein. In one embodiment, the storage device 220 is a non-volatile memory device or similar persistent storage device and media. For example, the storage device 220 is a hard disk drive, a floppy disk drive, a CD-ROM device, a DVD-ROM device, a DVD-RAM device, a DVD-RW device, a flash memory device or another mass storage device known in the art. In one embodiment, the storage device 220 comprises a dynamic random access memory (DRAM) device, a static random access memory (SRAM) device, flash memory or some other memory device known in the art. In another embodiment, the storage device 220 comprises a combination of volatile memory and non-volatile memory. The storage device 220 is coupled to the bus 240 for communication with other components of the server 120. While shown in FIG. 2 as included in the server 120, in other embodiments, the storage device 220 is coupled to the server 120 via the network 130 or via a direct connection between the storage device 220 and the server 120.

The storage device 220 includes instructions and/or data for implementing an assignment exchange or auction. In one embodiment, the storage device 220 includes an interface module 221, a constraint module 222, a bidder configuration module 223, a bidder data store 224, an auction data store 226, an allocation module 227 and a reporting module 228. However, in other embodiments, the storage device 220 includes different and/or additional modules than the ones depicted in FIG. 2.

The interface module 221 stores instructions or data that, when executed by the processor 210 or another processor, generates one or more user interfaces for receiving data from and/or presenting data to one or more bidders. For example, the interface module 221 includes instructions that, when executed by a processor 210, generate one or more of the user interfaces shown below in FIGS. 4-13 or other suitable user interfaces for presenting data associated with an assignment auction or exchange to a bidder and/or receiving data from a bidder. In one embodiment, data or instructions stored in the interface module 221 are communicated to the communication unit 230 via the bus 240, allowing transmission of data or instructions from the interface module 221 to a bidder device 110 for generation of a user interface.

In one embodiment, the user interface generated by execution of instructions from the interface module 221 allows one or more bidders to confirm a bid or to confirm modifications to one or more bids. For example, after a bidder enters one or more bids and a bidder device 110 receives an input to transmit the one or more bids to the server 120, a processor included in the bidder device 110 executes instructions from the server 120 and generates a bid confirmation message, allowing the bidder to again review and verify the bids before transmitting the bids to the server 120 via the network 130. In one embodiment, the bid confirmation message is displayed using a display of the bidder device 110 after the bidder device 110 receives the input to transmit the one or more bids, and responsive to the bidder device 110 receiving a bid confirmation input, the bids are transmitted to the server 120. Alternatively, the bid confirmation message is sent using e-mail, or using another messaging method, to the bidder, and the bidder replies to the bid conformation message using a suitable messaging method to confirm the bids and transmit the confirmed bids to the server 120. In one embodiment, the bid confirmation confirms the bids and transmits the bids to the server 120 if the bidder device 110 does not receive a confirmation message from the bidder within a predetermined time interval. Alternatively, after the predetermined time interval, modifications to prior bids are withdrawn and any previously confirmed bids are reinstated.

The interface module 221 also includes instructions or data describing communication between the server 120 and the plurality of bidder devices 110A-110N as well as communication of data between the storage device 220, the processor 210 and/or the communication unit 230. In one embodiment, messages, data stored in the interface module 221 is used to translate messages, such as bid messages, received from a bidder device 110 via the network 130 and the communication unit 230 into a data format usable by the other components of the server 120. The interface module 221 also formats reporting messages from the reporting module 228 describing the allocation of items at the completion of an auction or exchange which are routed via the bus 240 to the communication module 230 for transmission to one or more bidder devices 110.

In one embodiment, the interface module 221 receives messages, such as bid messages, from one or more bidder devices 110 and modifies a format associated with the message into a second format associated with the allocation module 227. For example, the interface module 221 receives messages, or other data, having an extensible markup language (XML) format and modifies the XML formatted data, as needed, for use by the allocation module 227. This allows messages to be transmitted between the server 120 and one or more bidder devices 110 in a normalized format and data from the messages to be communicates to the allocation module 227 in a format specified by the allocation module 227. Further, the interface module 221 and the auction data store 224 include data identifying the content of messages transmitted between the server 120 and one or more bidder devices 110, allowing customization of the messages for different auctions or exchanges or for different bidders in an auction or exchange.

The constraint module 222 stores rules and/or constraints affecting allocation of items and determination of market-clearing prices in an auction or exchange. Additionally, the constraint module 222 stores instructions or data that, when executed by the processor 210 or another processor, apply the stored rules and/or constraints during determination of the allocation of items and the market-clearing prices in an auction or exchange. For clarity, various examples of constraints or rules stored by the constraint module 222 are further described below. However, additional constraints or rules may be stored by the constraint module 222 to modify allocation of items in an exchange or auction.

For example, the constraint module 222 includes data describing substitute groups of items affecting allocation of items to a bidder. A substitute group is a plurality of items associated with each other so that when the price of a first item increases, causing a bidder to reduce the demand for the first item, the bidder's demand a second item in the substitute group rises or remains the same, but does not decrease. In one embodiment, a substitute group includes a plurality of bids and may also include a maximum total quantity for the group. For example, if a bidder reduces the quantity of a first item bid upon in the substitute group, the bidder is allowed to bid upon an increased quantity of one or more additional items in the substitute group. If a maximum quantity for the group is enforced, the units of items within the substitute group having the highest margin, or profit, for a buyer relative to the buyer's maximum price are filled first. Enforcement of a maximum quantity also first fills units for items within the substitute group having the highest margin for a seller relative to the seller's reserve price. In one embodiment, the server 120 receives a substitute group from a bidder device 110 associated with a bidder via the network 130 and the communication unit 230 and stores the substitute group along with an association between the substitute group and the bidder in the constraint module 222. For example, a substitute group received by the server 120 includes a parent identifier, a list of one or more bids or substitute groups and a maximum quantity. In one embodiment, an effectiveness coefficient is included in a bid message and the quantity included in the bid message is multiplied by the effectiveness coefficient included in the bid message when determining the quantity of the bid message for purpose of a substitution group. A parent identifier allows the server 120 to identify a substitute group within a set of hierarchically organized substitute groups, as substitute groups may be nested within each other to form a tree of constraints. If substitute groups are nested, a maximum quantity imposed on a substitute group limits the total quantity awarded to bids within the substitute group and awarded to any additional substitute groups nested within the substitute group; thus, the maximum quantity of all the bids in a first substitute group and in the substitute groups nested within the first substitute group is constrained to not exceed the maximum quantity of the first substitute group. In one embodiment, the interface module 222 allows a bidder, or another user, to specify and modify substitute groups by displaying substitute groups retrieved from the constraint module 222 in a tree structure or in another hierarchical format.

Use of substitute groups allows the assignment exchange and auction system 100 to efficiently execute a swap bid, which is a linked group of a bid to buy and a bid to sell in which the total quantity bought and the total quantity sold are equal. In one embodiment, the assignment exchange and auction system 100 treats a buy quantity as positive and a sell quantity as negative, allowing a swap bid to be implemented as a substitute group having a maximum quantity of zero.

In one embodiment, in addition to substitute groups, the constraint module 222 includes a logical group including one or more groups nested within the logical group and a maximum quantity associated with the logical group. A group nested within the logical group is associated with a quantity of one or zero depending on whether bids within the nested group are filled; if a bid within the nested group is allocated one or more items, the nested group is associated with a quantity of one, while if no bids within the nested group are allocated an item, the nested group is associated with a quantity of zero. Hence, in a logical group, quantities associated with nested groups are either one or zero; the logical group may also include one or more bids, and the quantity associated with a bid is the quantity of items allocated with the bid. Therefore, when determining whether a logical group equals or exceeds the maximum quantity associated with the logical groups, the total quantity of items is combined with the one or zero value associated with groups nested within the logical group. In contrast, a substitute group determines the total quantity associated with the substitute group by totaling the quantities of items allocated to bids within the group and also to bids within groups nested within the substitute group.

As another example, the constraint module 222 includes data describing one or more complements, which occur when a bidder desires more of a first item when the bidder is assigned more of an item that is a complement of the first item. For example, if a bidder has an economy of scope, the bidder may place a higher value on a set of items together than on the set of items without one or more of the set's constituent items. As another example, data describing one or more complements is used to identify a contingent bid specifying that a second bid is to be filled responsive to filling a first bid while the second bid is not filled if the first bid is unfilled. In various embodiments, the assignment exchange and auction system 100 specifies complements using group minimums or group fixed costs stored in the constraint module 222. For example, a minimum quantity is associated with a group of bids to specify a complement. In one embodiment, the server 120 receives a complements group including a parent identifier, a list of one or more bids, a maximum quantity associated with the group and a minimum quantity associated with the group. If a minimum quantity is associated with a group, a total of items less than the minimum quantity is not assigned to the group. In certain situations, the maximum quantity and the minimum quantity associated with a group are equal, creating a "fill-or-kill" group. In one embodiment, the interface module 221 includes data that, when executed by a processor, displays a fill-or-kill input element, allowing a bidder to specify a fill-or-kill group by interacting with the fill-or-kill input element associated with a group. For example, the user interface module 221 includes data for generating a check box or radio button, allowing user selection of the radio button or check box to indicate that a group associated with the check box or radio button is a fill-or-kill group.

Similar to a substitute group, a parent identifier included in a complement group allows the server 120 to identify a complement group within a set of hierarchically organized complement groups, as complement groups may be nested within each other to form a tree of constraints. If complement groups are nested within a first complement group, a minimum quantity imposed on a complement group applies to bids within the first complement group and bids within complement groups nested within the first complement group. In one embodiment, the interface module 221 allows a bidder, or another user, to specify and modify complement groups by displaying complement groups retrieved from the constraint module 222 in a tree structure or in another hierarchical format.

In other embodiments, the constraint module 222 identifies complements using a fixed cost associated with a group. A fixed cost specifies a minimum amount associated with a group of bids so that the fixed cost is exceeded before one or more bids in the bid group are filled. Hence, associating a fixed cost with a group regulates when a group is filled. In one embodiment, the server 120 receives a group associated with a fixed cost including a parent identifier, a list of one or more bids, a maximum quantity associated with the group, a minimum quantity associated with the group and a fixed cost associated with the group. In determining whether to fill a bid group associated with a fixed cost, the server 120 determines if the net profit on bids included in the bid group, including bids on a second group nested within the bid group, and does not fill bids in the bid group if the net profit does not exceed the fixed cost.

In an embodiment, the constraint module 222 includes a budget associated with a bidder that identifies a maximum amount the bidder is permitted to spend during an auction or exchange, regardless of the profits possible to the bidder. For example, a budget identifies a maximum monetary amount a bidder placing bids to buy is permitted to spend during an auction or exchange. As another example, a budget identifies a maximum amount of money, or another quantity, that a bidder placing bids to sell is permitted to receive, such as in a government-regulated sale stipulating a monetary amount of a government franchise to be sold. Similarly, an auction manager or other entity configuring the auction or exchange is permitted to limit the amount a bidder is permitted to spend based on credit associated with a bidder, regulatory considerations or other market design considerations. For clarity, a limit placed on a bidder by an auction manager or other third party, is referred to as a "credit limit." Both a budget, identified by the bidder, and a credit limit may be associated with a bidder with the most restrictive of the budget and the credit limit enforced to limit allocation of items in the auction or exchange.

In an additional embodiment, the constraint module 222 includes a quota associated with a bidder or associated with an item. While a budget places a limit on the amount of money, or another quantity, that a bidder is permitted to spend or to receive, a quota places a limit on the amount of an item used to fill one or more bids. A quota may be associated with a bidder to limit the amount of an item that the bidder is permitted to receive or a quota may be associated with an item to limit the number of items allocated during an auction or an exchange. In one embodiment, the constraint module 222 enables quotas for different items to be associated with multiple bidders.

The above-described constraints are merely examples, and in other embodiments, the constraint module 222 includes any data limiting or modifying the allocation of items among bidders. For example, the constraint module 224 includes data allowing a single bid in a specified set of bids to be filled, while the remaining bids in the specified set are unfilled. However, in other embodiments additional constraints affecting the allocation of items among bidders based on received bids are stored in the constraint module 222.

The bidder configuration module 223 stores data describing characteristics of bidders, such as bidder preferences or bidder limitations. Additionally, the bidder configuration module 223 stores instructions or data that, when executed by the processor 210 or another processor, apply the stored bidder characteristics when allocating items, determining market-clearing item prices in an auction or exchange and/or presenting data to a bidder. In one embodiment, the bidder configuration module 223 and the constraint module 222 communicate data to the processor 210 via the bus 240 to modify allocation of items in an auction or exchange.

For example, the bidder configuration module 223 includes data enabling a bidder to place bids for an item at a market price in a uniform price auction, such as market price enabling data associated with a bidder identifier. Additionally, the bidder configuration module 223 specifies a maximum number of market price bids associated with a bidder identifier, limiting the number of market price bids placed by the bidder to allow conventionally-priced bids to set the market clearing price of an item. As another example, the bidder configuration module 223 includes data describing a supply curve or a demand curve a bidder associates with an item. In one embodiment, for an item a bidder identifies a plurality of prices and associates quantities with each of the prices, allowing the bidder to describe changes to item quantity based on the item price. For example, the bidder configuration module 223 stores a table of prices and quantities, with a price associated with a quantity and associates the table with a bidder identifier and with an item identifier. Storing a supply curve or a demand curve allows bidders to simply and conveniently express price-dependent variations in item quantities.

As another example, the bidder configuration module 223 associates one or more options specifying data presented to a bidder with a bidder identifier, such as data modifying the data communicated to a bidder device 110 by the interface module 221 for presentation to a bidder. Thus, the bidder configuration module 223 allows the assignment exchange and auction system 100 to modify data presented to bidders based on the bidder complexity. For example, the bidder configuration module 223 communicates data to the interface module 221 to communicate a user interface including a subset of the bidder options or data used during an auction or exchange to a bidder device 110 associated with a first bidder, simplifying participation in the auction or exchange for the first bidder. Alternatively, the bidder configuration module 223 communicates data to the user interface module 221 to communicate a user interface including an increased number of bidder options or data used during an auction or exchange to a second user, allowing the second user to benefit from the variety of options and/or data used by the assignment exchange and auction system 100.

In one embodiment, the bidder configuration module 223 includes data or instructions that, when executed by the processor 210 or another processor, enable a bidder to express item valuation while maintaining the bidder's privacy for item valuations not used in an assignment auction or exchange. To calculate a result of an assignment auction or exchange where one or more substitutes are used, unsuccessful bids are used in the allocation; however, in some embodiments, unsuccessful bids are desired to remain private, even from the auctioneer or other entity involved in the auction. Hence, execution of the assignment exchange or auction relies on bids to be simultaneously present for optimization, while private bidding seeks to incrementally reveal relevant bids.

To allow an assignment exchange or auction with private bidding, the bidder configuration module 223 includes data describing an avowal method where a bidding agent is associated with a bidder and is private to the bidder. In one embodiment, the bidding agent comprises instructions or data communicated from the bidder configuration module 223 through the network 130 and the communication unit 230 to a bidder device 110 for execution by a processor included in the bidder device 110. When executed on the bidder device 110, the bidding agent submits the actual bid of a bidder using the bidder device 110 along with a set of false bids to the server 120 and stores data distinguishing the actual bid from the false bids. The biding agent is executed solely on the bidder device 110 associated with a bidder to maintain the privacy of the bidding agent. As the allocation module 227 does not differentiate between the bidder's actual bid and the false bids, the exchange or auction result is determined using the actual bid as well as the false bids. After identifying a bid with the highest margin assigned to one or more items, the allocation module 227 and processor 210 communicate an avowal request to the bidder device 110, where the bidding agent avows or disavows the bid by communicating a response to the server 120 via the network 130. If the response avows the bid, the allocation module 227 identifies a second bid having the second highest margin. If the response disavows the bid, the allocation module 227 deletes the bid and re-calculates the assignments.

In one embodiment, data describing the bidding agent transmitted from the bidder configuration module 223 to a bidder device 110 removes the bidding agent when the auction or exchange is completed. Such a configuration prevents anyone, including the bidder, from distinguishing the actual bid, or actual bids, from the false bids. Without the bidding agent, the actual losing bids and the false losing bids are not distinguishable from each other. In one embodiment, one or more of the bids submitted by the bidding agent are reduced from their true price to allow the prices of bids that are filled at a lower or a higher price based on a price determination rule to also be disguised.

The bidder data store 224 comprises a portion of the storage device 220 including data identifying one or more bidders. In one embodiment, the bidder data store 224 associates a unique bidder identifier with each bidder. For example, the bidder data store 224 includes a logon and password associated each bidder. In addition to storing a bidder identifier associated with bidders placing bids in an auction, the bidder data store 224 also includes a bidder identifier associated with bidders, or other users, who access the server 120 to configure or operate an auction or exchange. The bidder data store 224 exchanges data with the bidder configuration module 223 via the bus 240 to associate characteristics with a bidder. Although FIG. 2 shows the bidder data store 224 and the bidder configuration module 223 as discrete components, in other embodiments, the bidder data store 224 and the bidder configuration module 223 comprise a single component including data identifying bidders and data describing characteristics associated with bidders.

The auction data store 226 comprises a portion of the storage device 220 including data describing configuration of an auction and/or data describing a completed auction or exchange. In one embodiment, the auction data store 226 includes an auction identifier associated with an auction, and stores data describing configuration of the auction associated with the auction identifier. For example, the auction data store 226 includes data identifying bidders and items participating in the auction, the content and format of messages from the server 120 to bidder devices 110 in an auction, pricing and/or allocation rules associated with the auction, the content of interfaces presented to bidders and/or additional information describing configuration of an auction. Storing auction configuration data in the auction data store 226 allows a bidder, or another user of the server 120, to clone an existing auction, simplifying auction configuration by reducing errors and set-up time associated with initial auction configuration.

In one embodiment, the auction data store 226 includes data or instructions, that when executed by the processor 210, for executing an assignment auction or exchange in multiple stages. To execute a multiple stage assignment auction or exchange, the auction data store 226 includes rules identifying bidders are permitted to bid in a stage and what bidders are permitted to bid in a stage. A multiple stage assignment auction or exchange allows a bidder to ascertain what other bidders are bidding before placing a bid having a maximum value. For example, in an assignment auction or exchange to sell, an artificially high supply is posted in the initial round. In one embodiment, bidders placing a winning bid in a first round advance to a second round, and in an auction or exchange to sell, a bidder is permitted to decrease its overall quantity, but is not permitted to increase its overall quantity, in a later round. In one embodiment, the auction data store 226 also includes criteria or rules on quantities and prices for different rounds in an assignment exchange or auction as well as rules or criteria regarding advancement of bidders and/or bids to a subsequent round.

The allocation module 227 stores instructions or data that, when executed by the processor 210 or another processor, determine item prices and allocate items among bidders. In one embodiment, the allocation module 227 describes a mixed-integer problem solver to determine winners and prices while also enforcing constraints from the constraint module 222. For example, the lowest of a bidder's budget and a bidder's credit limit affects allocation of items. In one embodiment, if a bidder buys or sells more than the lowest of the bidder's budget or credit limit, the allocation module 227 uses an iterative process to reduce the price or quantity allocated to the bidder by tan amount and re-allocates items based on the reduced price or quantity. In an alternative embodiment, responsive to a bidder exceeding the bidder's budget or credit limit, the allocation module 227 implements a fixed-point process to modify item prices so that the market of items in the auction clears while budgets or credit limits are satisfied. The allocation module 227 also accounts for bidder quotas when allocating item by determining whether the sum of bids filled for a bidder exceeds a quota associated with the bidder or associated with an item. The allocation module 227 assigns items to bidders so that the total difference between the maximum prices of bids to buy and the minimum prices of bids to sell—the reported gains from trade—are maximized.

In one embodiment, the allocation module 227 includes data or instructions that implement a mixed integer program solver when executed by the processor 210. For example, the allocation module 227 identifies an objective having an element for each bid and bid group, where the value of the objective is the price of a bid, either a reserve price for a bidder offering to sell or a maximum price for a bidder offering to buy. Generally, the allocation module 227 determines a vector for an item in the auction or exchange that ensures market clearing, where the number of the item bought equals the number of the item sold. In one embodiment, the allocation module 227 represents a constraint from the constraint module 222 as a vector and a column within the mixed integer program solver.

In addition to allocating items among bidders, the allocation module 227 also determines item pricing using one or more pricing rules. For example, the allocation module 227 determines whether pricing rules where minimum market clearing prices are used, where maximum market prices are used or where the bid price is used. When the bid price is used, participating bidders making bids to buy receive their bid and participating bidders making bids to sell also receive their bid to sell; however, use of bid prices may result in total payments exceeding total receipts. When minimum market clearing prices are used, the price used is uniform for multiple bidders and is the lowest price that clears the market. Similarly, when maximum market clearing prices are used, the price used is the highest price that clears the market. However, the above-identified pricing rules are examples, and in other embodiments, the allocation module 227 uses different pricing rules, such as Vickrey prices or Day-Milgrom core-selecting prices. By including pricing rules separate from the messaging and allocation rules, the assignment exchange and auction system 100 allows greater customization of an auction or exchange.

Additionally, the allocation module 227 includes instructions describing a tie-breaking procedure used when multiple bidders have identical margins for an available item. For example, the allocation module 227 includes data or instructions describing a random price tie-breaking procedure where a priority score is assigned to each bidder as the bidder is included in the auction. Assigning the priority score to a bidder when the bidder is assigned to the auction allows an auditor to duplicate the entire auction or exchange process, including tie breaking, from data stored in the storage device 220. The priority score determines which bidder is assigned a quantity of an item in the event of a tie. In one embodiment, the allocation module 227 also allows a bidder, such as an auction administrator, having administrative privileges to manually override the priority score to give an advantage to a first bidder over other bidders in the event of a price tie. Similarly, if a bidder has the same margins for each of several items, the items are allocated a priority score, similar to the process described above, and the priority score is used to determine the items associated with the bidder. Thus, the allocation module 227 provides a reliable and reproducible method of breaking ties.

The reporting module 228 stores instructions or data that, when executed by the processor 210 or another processor, generate data describing results of a completed auction or exchange. In one embodiment, data from the allocation module 227, the reporting module 228 and the interface module 221 is communicated to the processor 210 via the bus 240, and the processor 210 executes the data to generate output describing the results of an auction or exchange. For example, the reporting module 228 includes data describing presentation of a tree display of bids shown to various bidders, allowing bidders to view the hierarchy of substitution or complementaries specified by a bidder. In one embodiment, the reporting module 228 causes a margin to be displayed along with a bid in the tree display of bids. For bids, the margin identifies the difference between the bid price for an item and the market clearing price for the item. For a bid to buy, the margin is the difference between the bid and the market clearing price, while for a bid to sell, the margin is the difference between the reserve price and the market clearing price. A positive margin represents the unit profit for a bidder on an item. In one embodiment, the lowest margin of any bid included in a group of bids is displayed by the reporting module. In addition to displaying the bids optimizing total profit across multiple bids, in response to receiving an input, the reporting module 228 displays one or more sets of non-optimal bids, allowing bidders to verify that the auction produced an optimal allocation of items and a fair item price. In an embodiment, the reporting module 228 restricts the data reported to one or more bidders, so that the one or more bidders receive the minimum amount of information suitable for verifying the correctness of the assignment auction or exchange and the results of the one or more bidders.

In one embodiment, the reporting module 228 also generates data comparing the results of the assignment exchange or auction to an alternative multi-product clock auction with proxy bidders. The results of the assignment exchange or auction provide the end pints of the clock auction, allowing the data to provide a model of a perfect clock auction that determines the prices in each round of the clock auction and bidders to set their quantities. For example, the multi-product clock-auction simulation describes a forward auction where prices rise over rounds. In the forward multi-product clock-auction, the sellers' reserve price is the starting price for items and a round-increment price is determined by an algorithm considering the number of rounds to be approximated, known starting prices, known ending prices and the number of items. For a round in the simulated multi-product clock auction, the reporting module 228 determines what bids would be made at the determined set of item prices then determines the item prices for the subsequent round. If an item price results in demand for the item to exceed the supply of the item, the item price is incremented by the calculated round-increment price; however, if the incremented item price exceeds the market clearing price determined by the assignment auction or exchange, the market clearing price for the item is used. A simulated multi-product clock auction report describes, for multiple rounds in the multi-product clock auction, an item, the item price, the item supply and the item demand. The last round described by the simulated multi-product clock auction report shows the same result as the assignment exchange or auction, avoiding the complexity of final round rollbacks occurring in a conventional multi-product clock auction.

The communication unit 230 is coupled to the bus 240 and transmits data from the server 120 to the network 130 and receives data from the network 130. In one embodiment, the communication unit 230 includes a port for direct physical connection to the network 130. For example, the communication unit 230 includes a USB, SD, CAT-5 or similar port for wired communication with the network 130. In another embodiment, the communication unit 230 includes a wireless transceiver for exchanging data with the network 130 using one or more wireless communication methods, such as IEEE 802.11, IEEE 802.16, BLUETOOTH® or another suitable wireless communication method. In yet another embodiment, the communication unit 230 includes a cellular communications transceiver for sending and receiving data over a cellular communications network such as via short messaging service (SMS), multimedia messaging service (MMS), hypertext transfer protocol (HTTP), direct data connection, WAP, e-mail or another suitable type of electronic communication. In still another embodiment, the communication unit 230 includes a wired port and a wireless transceiver. The communication unit 230 also provides other conventional connections to the network 130 for distribution of files and/or media objects using standard network protocols such as TCP/IP, HTTP, HTTPS and SMTP as will be understood to those skilled in the art.

Method of Operation

Figure 3:
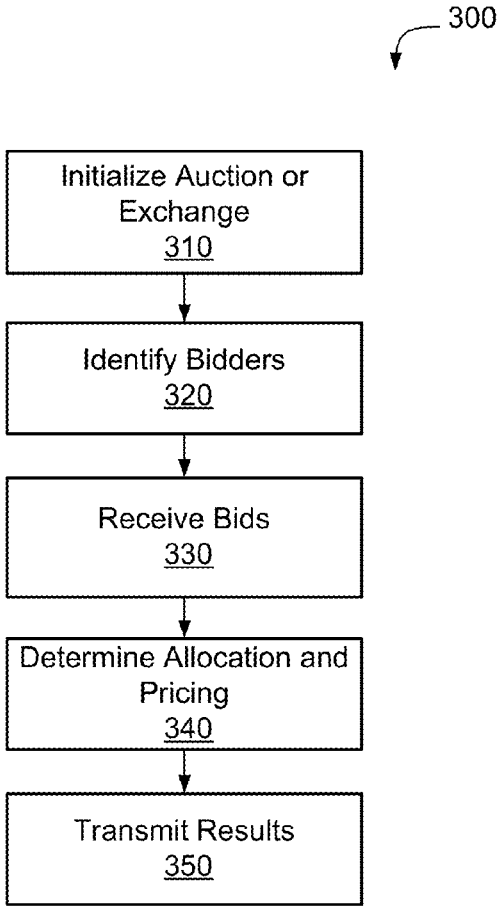
FIG. 3 is a flow chart of a'method for performing an assignment auction or exchange according to one embodiment of the present invention.

FIG. 3 shows a method 300 for performing an assignment auction or exchange according to one embodiment of the present invention. In one embodiment, the steps described in conjunction with FIG. 3 are implemented by instructions or other data stored on a tangible computer-readable storage medium, such as a flash memory, an optical disk, a hard disk or other suitable storage device, that cause a processor to perform the described steps when executed by the processor. Further, in other embodiments, the method 300 includes different and/or additional steps than those described in conjunction with FIG. 3.

Initially, an auction or exchange is initialized 310 by a bidder, a system administrator or another entity with authority to retrieve or modify data from an auction data store 226 included in the server 120 or with authority to store data to the auction data store 226. In one embodiment, a bidder or another entity is appointed as the master of ceremonies or the auctioneer associated with the auction. For example, data is stored in a bidder data store 224 and associated with a bidder identifier to identify the auctioneer or the master of ceremonies. As another example, a bidder identifier, such as a login and password, is created, associated with the master of ceremonies or auctioneer and stored in the bidder data store 224 of the server 120. In many embodiments, the master of ceremonies or auctioneer has limited privileges, such as the ability to configure auctions for a specific account but not the ability to appoint an auctioneer or master of ceremonies for another account. In an embodiment, the auctioneer or master of ceremonies has limited financial control over the bid amounts or total amount of bids.

During initialization, data describing the auction or exchange is stored in an auction data store 226 included in the server 120. For example, data identifying items participating in the auction, the content and format of messages from the server 120 to bidder devices 110 in an auction, pricing and/or allocation rules associated with the option, the content of interfaces presented to bidders and/or additional information describing configuration of an auction is stored in the auction data store 226. In one embodiment, data from an interface store 221 included in the server 120 is modified or retrieved to describe the presentation of data to bidders using bidder device 110. For example, data describing one or more user interfaces, such as the user interfaces further described below in conjunction with FIGS. 4-13, is retrieved from the interface store 221 and used by an auction. In one embodiment, the auction or exchange is initialized 310 by retrieving data describing a previously completed auction or exchange form the auction data store 226, allowing a previously completed auction or exchange to be cloned for subsequent use.

Bidders participating in the initialized auction or exchange are also identified 320. In one embodiment, bidder identifiers associated with participating bidders are stored in the bidder data store 224 in the server 120 or data is stored in the bidder data store 224 to identify bidder identifiers associated with bidders participating in the auction. In one embodiment, data describing characteristics of identified bidders, such as bidder preferences or bidder limitations is stored in the bidder configuration module 223, along with data or instructions for applying the stored bidder characteristics during the initialized auction or exchange to determine the allocation of items and the market-clearing prices in an auction or exchange. For example, the bidder configuration module 223 includes data enabling a bidder to place bids for an item at a market price in a uniform price auction, specifying a maximum number of bids that a bidder may place at the market price and/or options identifying data presented to a bidder by the interface module 221 for presentation to a bidder.

In one embodiment, after identifying 320 the bidders participating in the assignment exchange or auction, the server 120 transmits invitations to participate in the auction or exchange to bidder devices 110 associated with the identified bidders using the communication unit 230 and the network 130. For example, an invitation specifies whether a bidder associated with a bidding device 110 receiving the invitation places bids to buy or bids to sell in the auction or exchange. In one embodiment, the invitation transmitted form the server 120 to a bidder device 110 includes data or instructions from the interface module 221 and/or from the bidder configuration module 223 that, when executed by a processor in the bidder device 110, displays a user interface to the bidder, such as one or more of the user interfaces described below in conjunction with FIGS. 4-13. Transmitting data or instructions describing one or more user interfaces from the server 120 to one or more bidder devices 110 allows the one or more user interfaces to be modified or customized at the server 120, simplifying presentation of different user interfaces to different bidders.

After identifying 320 the bidders, the server 120 receives 330 bid messages describing bids to buy, bids to sell, and/or bids to swap from one or more bidder devices 110 through the network 130 and the communication unit 230. In one embodiment, one or more bid messages also include one or more constraints associated with a bidder, which are stored in the constraint module 222 of the server 120. Alternatively, the server 120 separately receives data describing one or more constraints and stores the constraints in the constraint module 222. In one embodiment, at a set time, after a set time interval has elapsed or responsive to the occurrence of another event identified by data in the auction data store 226, the auction or exchange is closed. When the auction or exchange is closed, the allocation module 227 included in the server 120 determines 340 the pricing of items and the allocation of items among bidders using the received bid messages while accounting for constraints stored in the constraint module 222, if any. In one embodiment, the allocation module 227 performs steps described in U.S. patent application Ser. No. 12/340,999, which is incorporated by reference herein in its entirety, to determine item prices and allocate items among bidders. The allocation module 227 awards quantities as the solution of a particular linear program that maximizes the difference between the total values of the awarded bids to buy minus the total value of the awarded offers to sell, as described above in conjunction with FIG. 2. For example, the difference between the total monetary value of the awarded bids to buy less the total monetary value of the awarded offers to sell is maximized by the allocation module 227 when allocating items among bidders.

After allocating items among bidders and determining item prices, the reporting module 228 included in the server 120 generates data describing the results of the completed auction or exchange and notifies bidders of the results by transmitting 350 one or more messages describing the results to one or more bidder devices 110. For example, the server 120 notifies bidding devices 110 of auction results via e-mail messages, text messages, web service communications over the network 130 or other methods of data communication. In one embodiment, the data describing auction results is modified according to data in the bidder configuration module 223 to allow different bidders to be presented with different levels of detail about the completed auction.

It is clear that many modifications and variations of this embodiment may be made by one skilled in the art without departing from the spirit and scope of this disclosure. For example, depending on the auction, who holds the auction, and who takes the bids to buy and sell, different constraints may be published and stored in the constraint module 220 for resolving bids. These modifications and variations do not depart from the broader spirit and scope of the invention, and the examples cited here are to be regarded in an illustrative rather than a restrictive sense. The approach described here can be used both online and, in simple cases, offline. Also, sellers might be limited to a single offer, or, in more commoditized situations, many bids, sometimes in regular time intervals, sometimes as a one time or occasional auction.

Example User Interface

In the assignment exchange and auction system 100, specification of auction constraints, restrictions or combinations, typically in the form of rules, modifies implementation of the auction or exchange. To simplify entry of rules or constraints, as well as entry of bids, in one embodiment, the assignment exchange and auction system 100 includes one or more user interfaces to simplify presentation of auction data to bidders and receipt of auction data from bidders. For example, a processor included in a bidder device 110 executes instructions received from the server 120 via the network 130 to generate one or more user interfaces. FIGS. 4-13 provide various examples of graphical user interfaces used by the assignment exchange and auction system 100 to receive and present data.

Figure 4:
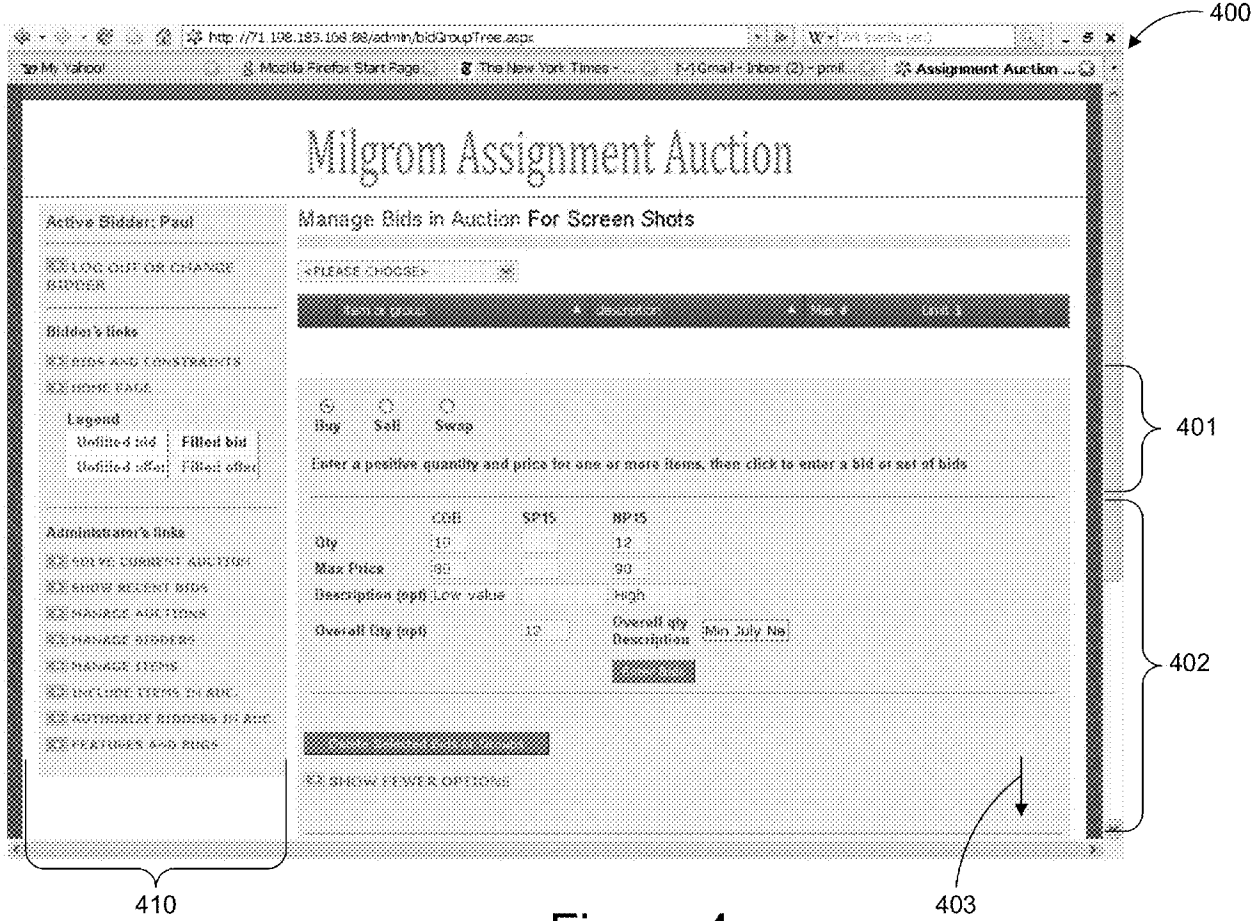
FIGS. 4-13 are graphic representations of example user interfaces generated by assignment exchange and auction system in accordance with embodiments of the present invention.

FIG. 4 shows one embodiment of a user interface 400 for receiving auction rules from a bidder, allowing a bidder to place restrictions on bids or offers. In one embodiment, the user interface 400, and the additional example user interfaces described below in conjunction with FIGS. 5-13, are generated by a processor included in a bidder device 110 executing instructions received from the interface module 221 of a server 120 via the network 130. The user interface 400 includes a dashboard section 410 displaying auction or exchange data, such as auction or exchange parameters, auction or exchange listings, auction or exchange participants or other data describing an auction or exchange. While the example of FIG. 4 illustrates the dashboard section 410 on the left side of the user interface 400, in other embodiments the dashboard section 410 has a different location, such as the right side of the user interface 400 or another location within the user interface 400.

The user interface 400 also includes a transaction section including a bid type portion 401 and a data entry portion 402. The bid type portion 401 receives data from a user identifying a type of bid. In the example shown in FIG. 4, the bid type portion 401 allows a user to identify a bid as a buy bid, a sell bid or a swap bid, which is a combination of one or more bids to buy and one or more offers to sell where the total quantities bought and sold are equal. For a bidder who is eligible only to buy or only to sell, the bid type portion 401 is omitted from the user interface 400 as a bidder with limited bid placement eligibility is unable to place different types of bids. The example of FIG. 4 is of a bidder who is eligible to buy, sell or swap entering a bid to buy.

The data entry portion 402 includes data identifying the items included in the auction or exchange as well as one or more text boxes or other data entry methods to receive an item quantity from a bidder and a maximum price per item from a bidder. In one embodiment, the data entry portion 402 also allows a bidder to provide a description of a bid placed for a quantity of an item at a maximum price. FIG. 4 depicts an example user interface where electricity delivered from locations COB, SP15 and NP15 is being traded, so the data entry portion 402 identifies the items in FIG. 4 by identifying the locations COB, SP15 and NP15. Fields associated with the locations are presented in the data entry portion 402, allowing a bidder to identify a quantity of electricity from a location and a maximum price for a unit of electricity from a location. In the example shown by FIG. 4, a bidder is requesting 10 units for purchase from COB at a maximum price per item of 80 and 12 units for purchase from NP15 at a maximum price per item of 90. In the example of FIG. 4, the maximum price per item at NP15 is higher because the hypothetical buyer is located in Northern California and the transmission cost from COB (California-Oregon border) reduces cost of energy delivered to the Northern California border.

The data entry portion 402 also enables the user to describe a bid group constraint. In the example of FIG. 4, a bid group constraint is entered to limit the overall quantity input for a group to 12, indicating that the bidder is not offering to buy more than 12 units of power in total from various locations. For example, if the group is assigned 12 units of electricity at NP15, zero units of electricity from COB and from SP15 are assigned to the group. Market clearing prices calculated during an auction or exchange account for data received via the data entry portion 402 when the system 100 allocates items among bidders. For example, suppose that the bids made by the bidder in the example of FIG. 4 exceed the computed market clearing prices. If the excess for NP15 is greater than the excess for COB, then the buyer is awarded twelve units of power at NP15. However, if the excess is greater for COB than for NP15, then the bidder is awarded its maximum quantity of 10 at COB and 2 more units at NP15 so that the bidder receives an overall quantity of 12, as specified in the data entry portion 402.

FIG. 4 illustrates an embodiment of the user interface 400 that includes an arrow 403 indicating the data entry portion 402 continues below the portion of the user interface 400 presented on a display device. In one embodiment, user input is received to modify the portion of the user interface 400 presented in the display device, allowing a bidder to view additional portions of the data entry portion 402. For example, a user, such as a bidder, provides input to a scroll bar or another element to modify the portion of the data entry portion 402 displayed on a display device.

In one embodiment, the items offered in an auction or exchange and identified using the data entry portion 402 are determined by an auctioneer based on custom parameters identified from consultation with important traders. Similarly, the participants in an auction or exchange may be determined by the auctioneer using custom parameters or via consultation with important traders.

Figure 5:
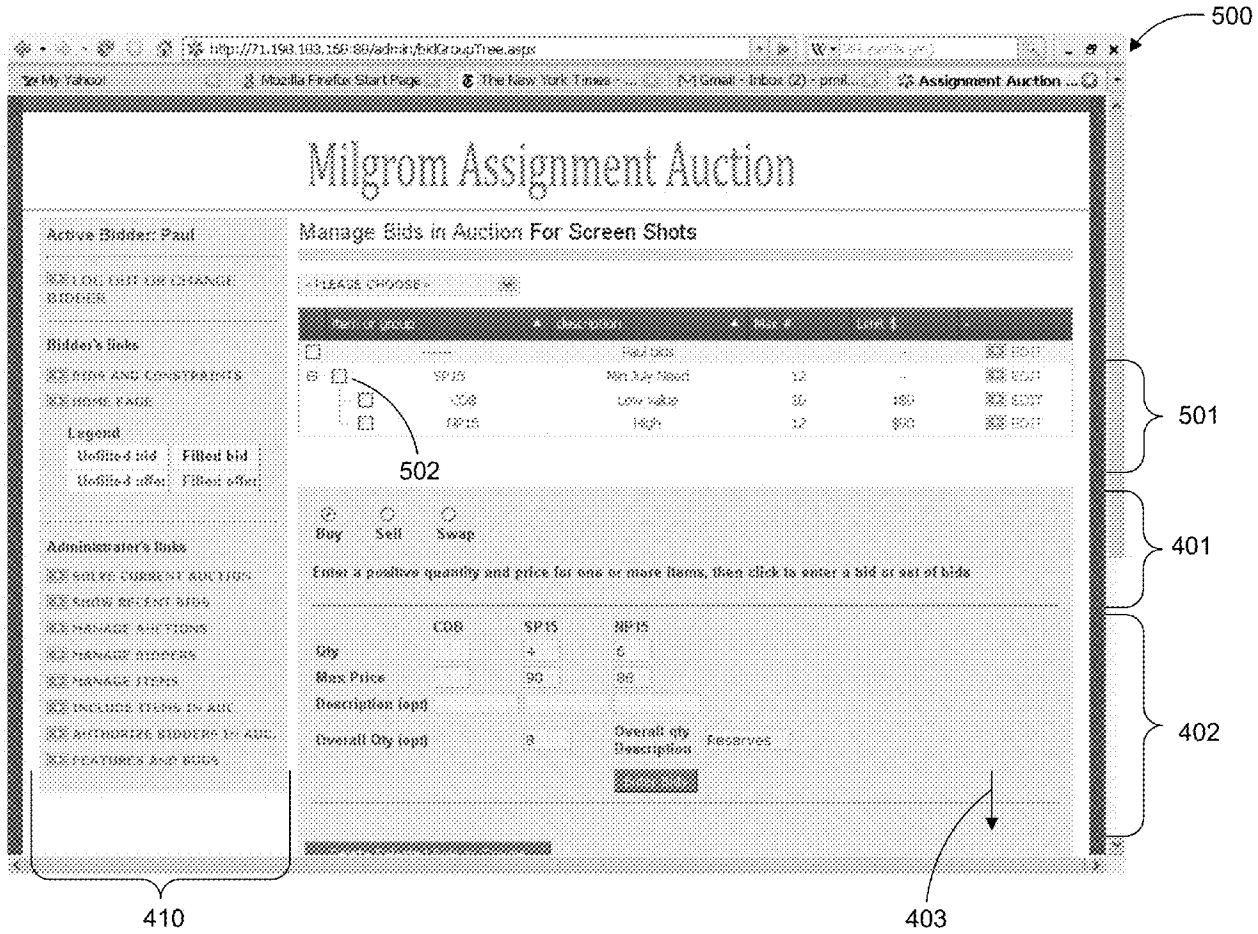

FIG. 5 shows one embodiment of a second user interface 500 identifying constraints on bids received via the data entry portion 402. For example, the user interface 500 is presented to a bidder after the system 100 receives data via the user interface 400 illustrated in FIG. 4. The user interface 500 includes a bid section 501 illustrating received bid groups 502, such as bid groups 502 received via the data entry portion 402. In the example of FIG. 5, the bid section 501 depicts the bids entered above in conjunction with FIG. 4 as tree constrains in the bid section 501. In one embodiment, the bid section 501 depicts received bids using a tree structure, allowing hierarchical application of constraints to received bids. To allow entry of additional bids and/or constraints, in one embodiment the second user interface 500 includes the bid type portion 401 and the data entry portion 402 described above in conjunction with FIG. 4. In the example of FIG. 5, additional bids are entered as FIG. 5 depicts a bidder entering a bid for four items from 5P15 at a per item price of 90 and a bid for six items from NP15 at a per item price of 88.

Figure 6:
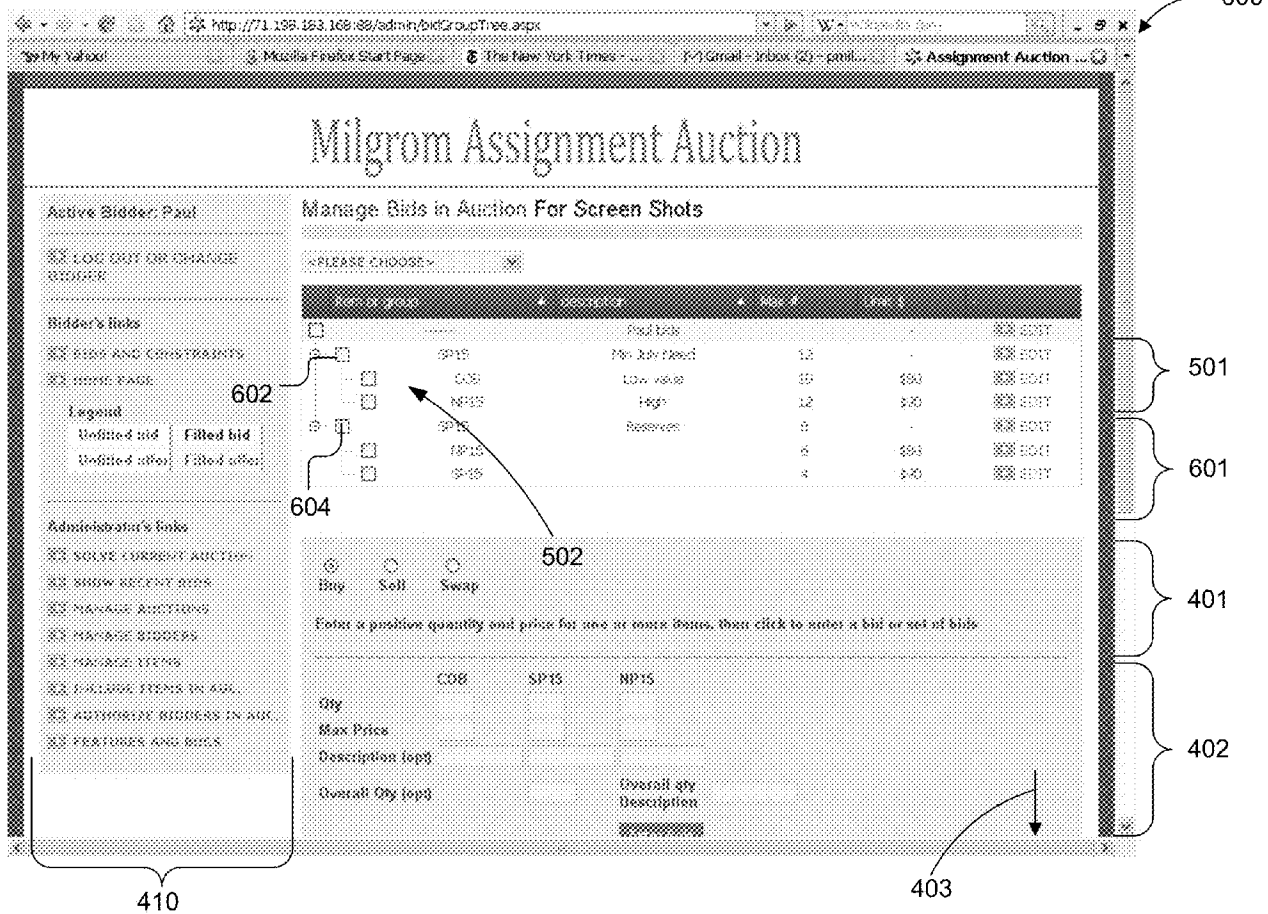

FIG. 6 shows an embodiment of a third user interface 600 presented after multiple bid groups are received from a bidder. For example, the third user interface 600 is presented after the additional bids identified in FIG. 5 are communicated to the server 202. The third user interface 600 includes a second bid section 601 identifying the additional bids. The bid section 501 depicts an expanded first bid tree 602 identifying bids included in a first bid group and the second bid section 601 depicts an expanded second bid tree 604 identifying bids included in a second bid group.

Figure 7:
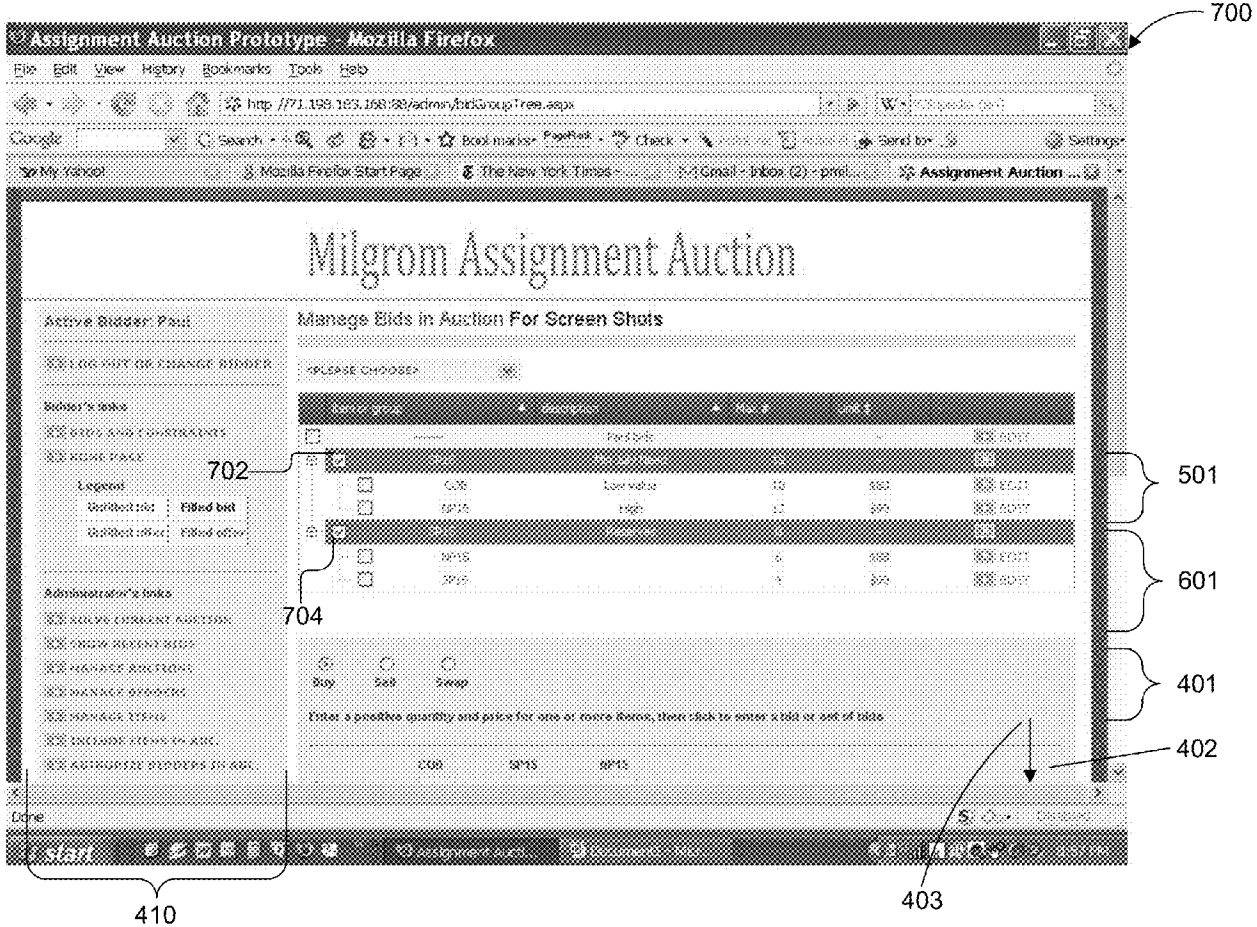
Figure 8:
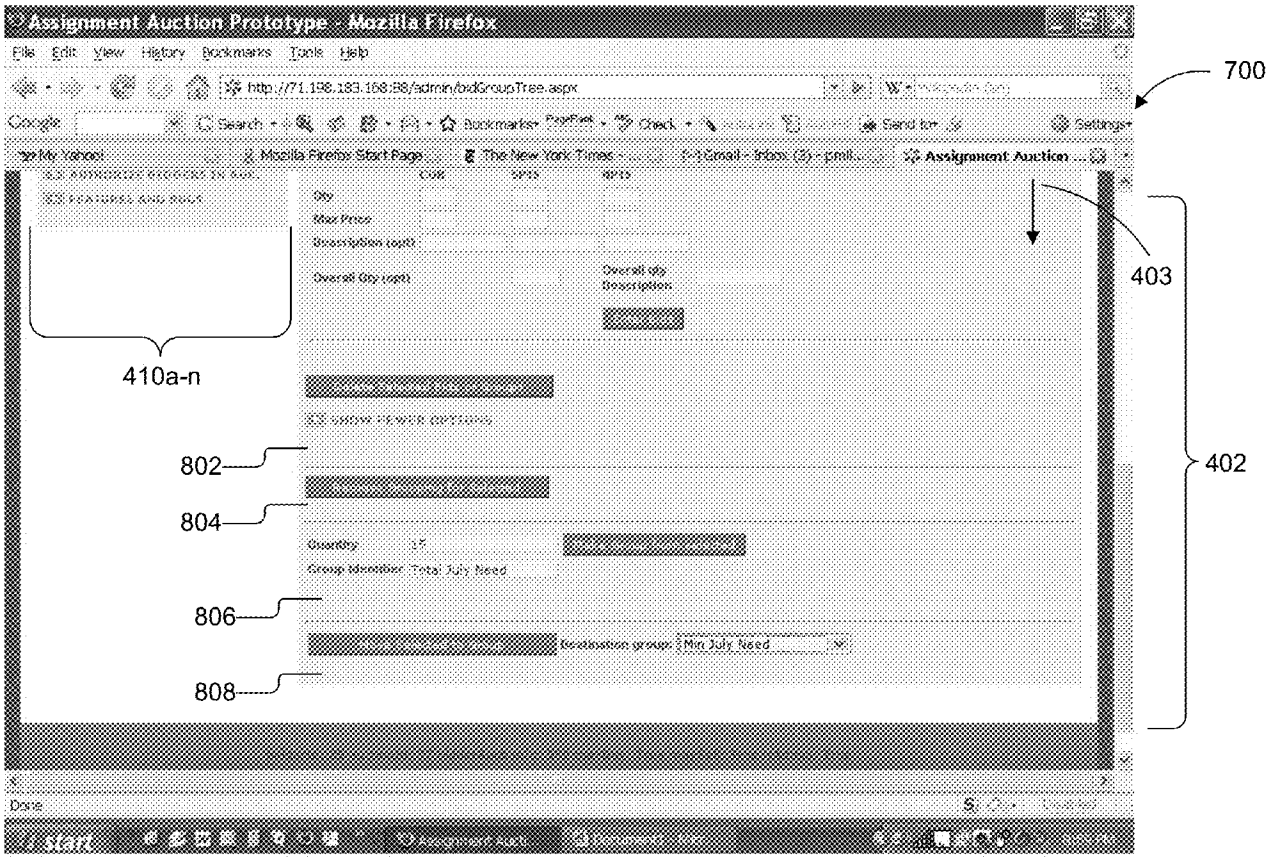

FIGS. 7 and 8 show an example of an additional user interface 700 displayed responsive to a user accessing one or more selection buttons 702, 704 associated with a bid group. Accessing a selection button 702, 704 associated with a bid group highlights a selected bid group, allowing editing of the bids included in a selected bid group. Additionally, accessing selection buttons 702, 704 associated with multiple bids allows the bids associated with the accessed selection buttons 702, 704 to be linked using an overall rule. For example, total quantity of the selected bid groups may be limited using a total quantity constraint so that the selected bids act as subrogated subsets of an overall bid. FIG. 8 shows additional components of user interface 700. For example, the components of the user interface 700 illustrated by FIG. 8 are visible via a trader system 206 responsive to receipt of an input to modify the portion of the user interface 700 presented in the display device.

As shown in FIG. 8, the data entry portion 402 includes additional subsections 802, 804, 806 and 808 for manipulating bid groups, bids and characteristics of the bid groups and/or bids. For example, a delete subsection 802 includes one or more data entry mechanisms to delete a bid group or a bid. In one embodiment, the delete subsection 802 also includes one or more data entry mechanisms for modifying one or more attributes or options associated with a bid or a bid group. For example, a bidder selects a bid or bid group using a selection button 702, 704 associated with the bid or bid group then accesses an element included in the delete subsection 802 to delete bid or bid group associated with the selected selection button 702, 704.

In one embodiment, a group removal subsection 804 receives input for removing a prior action grouping bids into a bidding group. The user interface 700 may also include a group creation subsection 806 receiving input from a user to create a group of bids or to associate a constraint with bids or bid groups. In the example depicted by FIG. 8, the group creation subsection 806 has received input setting a constraint that the total quantity assigned to the bid groups associated with the selection buttons 702, 704 is 15 so that the bid groups associated with the selection buttons 702, 704 comprise a single bid group having a total quantity constraint of 15. In one embodiment, the user interface 700 also includes a group modification subsection 808 that receives an input to move a bid group and an input identifying a bid group to which a selected bid group is moved, simplifying modification of hierarchical relationships between bids and/or bid groups.

Figure 9:
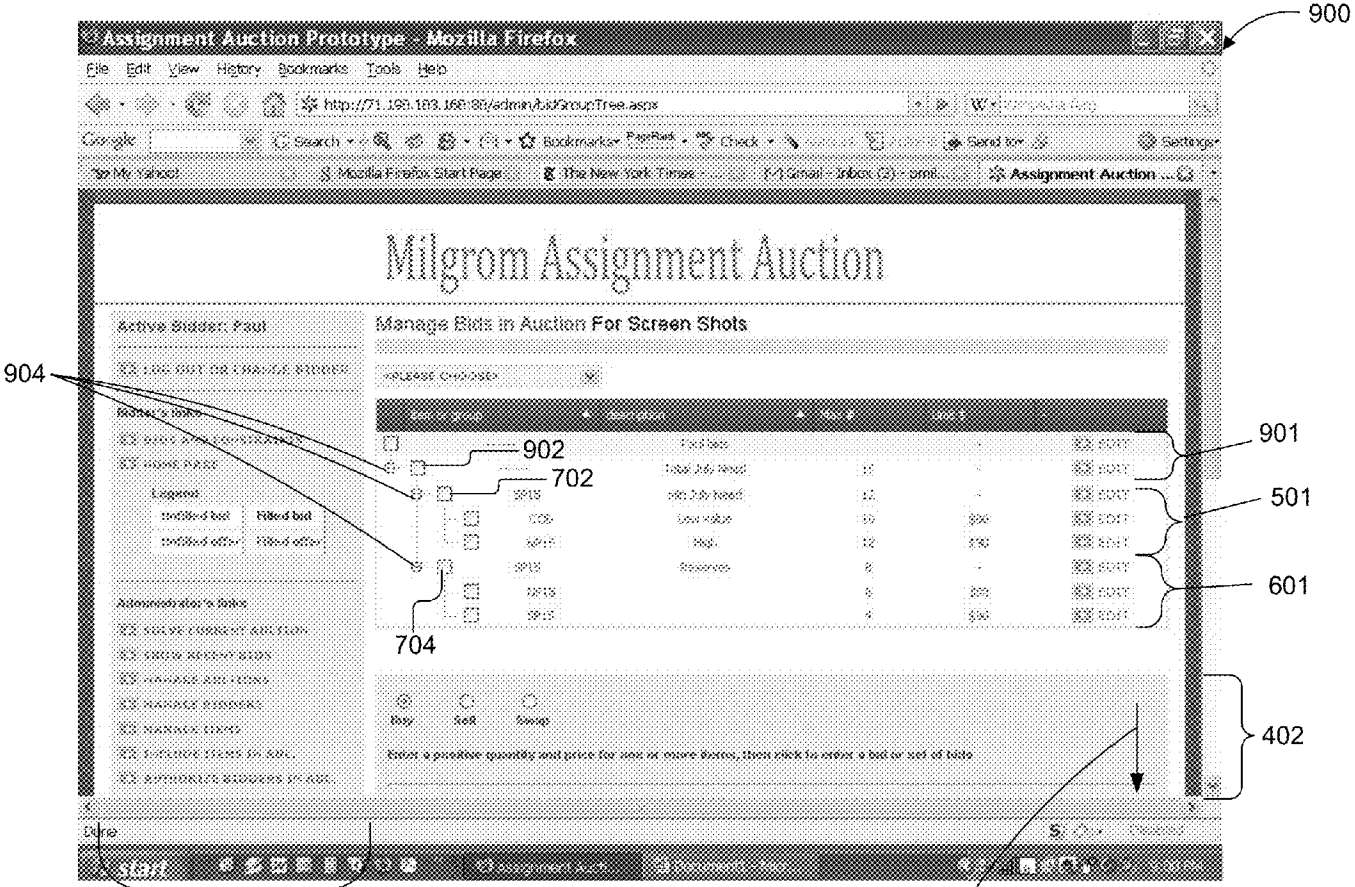

FIG. 9 shows an embodiment of a user interface 900 for generating a group from selected bids or selected bid groups. In one embodiment, the user interface 900 is displayed in response to user interaction with the group creation subsection 806 described above in conjunction with FIG. 8. For example, in response to an interaction with the group creation subsection 806 to generate a bid group including bids or bid groups associated with selection buttons 702, 704, the bid groups or bids are combined and a new bid group is generated and associated with a selection button 902. Generation of the new bid group also causes an additional bid section 901 to be displayed along with the bid section 501 and the second bid section 601 associated with previously received bids. The additional bid section 901 depicts a hierarchical structure of bid groups as the bid section 501 and the second bid section 601 are depicted as components of the additional bid section 901. The selection buttons 702, 704 are shown as linked on a branch of a tree indicating a total of 15 units in the additional bid section 901 and including two separate subrogated bids of 12 units in the bid section 501 and 8 units in the second bid section 601. Modification elements 904 are associated with the bid group section 501, the second bid group section 601 and the additional bid group section 901 to allow the bid groups to be expanded or collapsed to show the bids within a bid group. In one embodiment, the modification elements 904 allow presentation of the bids included in a bid group or of bid groups included in a combination of bid groups as parts of a tree, as is common in web-based user interfaces or other interfaces having hierarchical data structures, such as directory trees.

Figure 10:
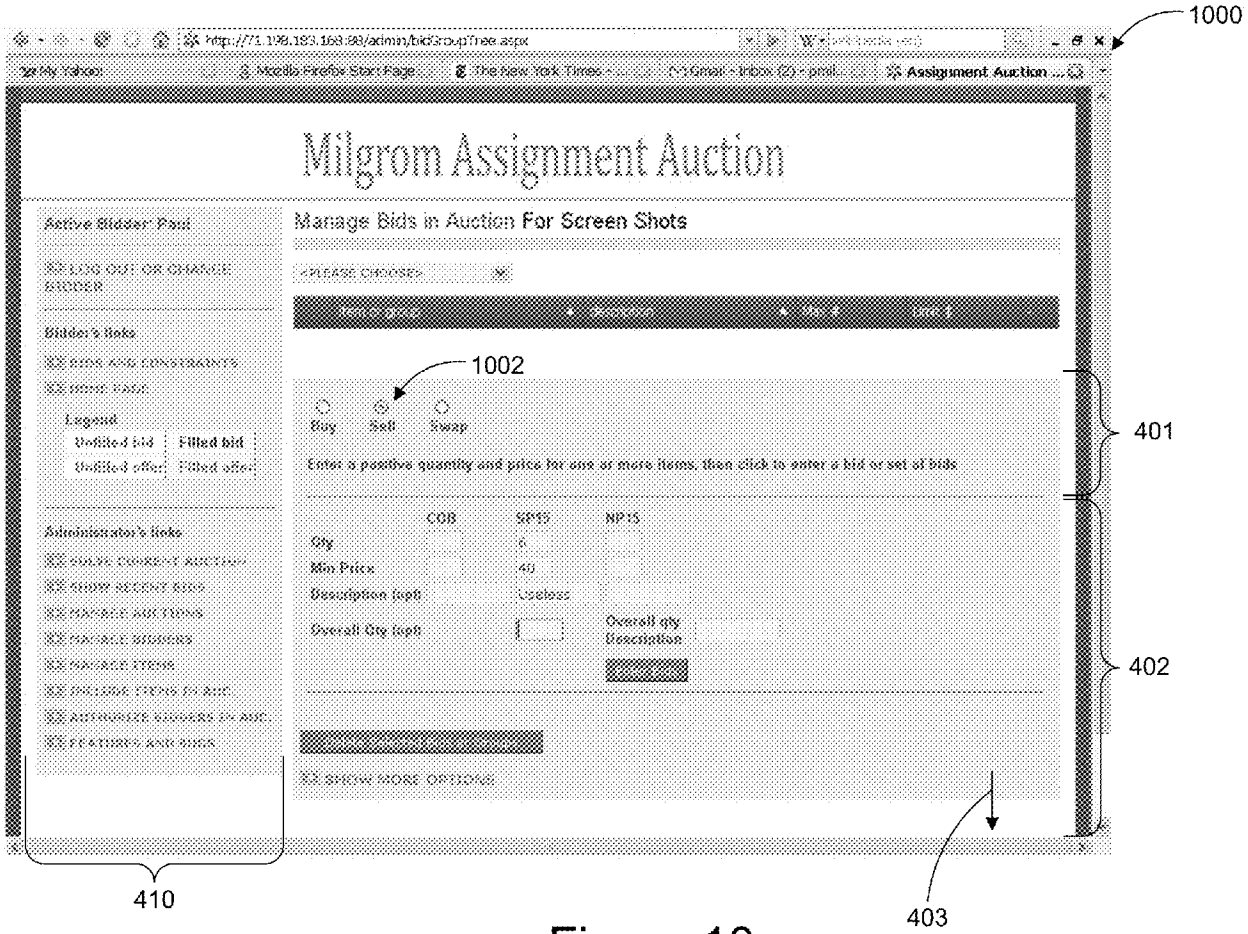

FIG. 10 shows an example embodiment of a user interface 1000 generated by the assignment exchange and auction system 100 receiving data from a bidder creating a bid to sell. The user interface 1000 is similar to that described above with reference to FIG. 4. In the example of FIG. 10, the bid type portion 401 indicates that the received data is for a bid to sell. For example, a user interacts with a radio button, or other suitable input mechanism 1002 to identify the bid as a bid to sell. Data identifying the item to be sold, such as the number of items being sold and the minimum price per item is received by the data entry portion 402 and communicated to the server 202 to create a bid to sell for use in an assignment exchange or auction.

Figure 11:
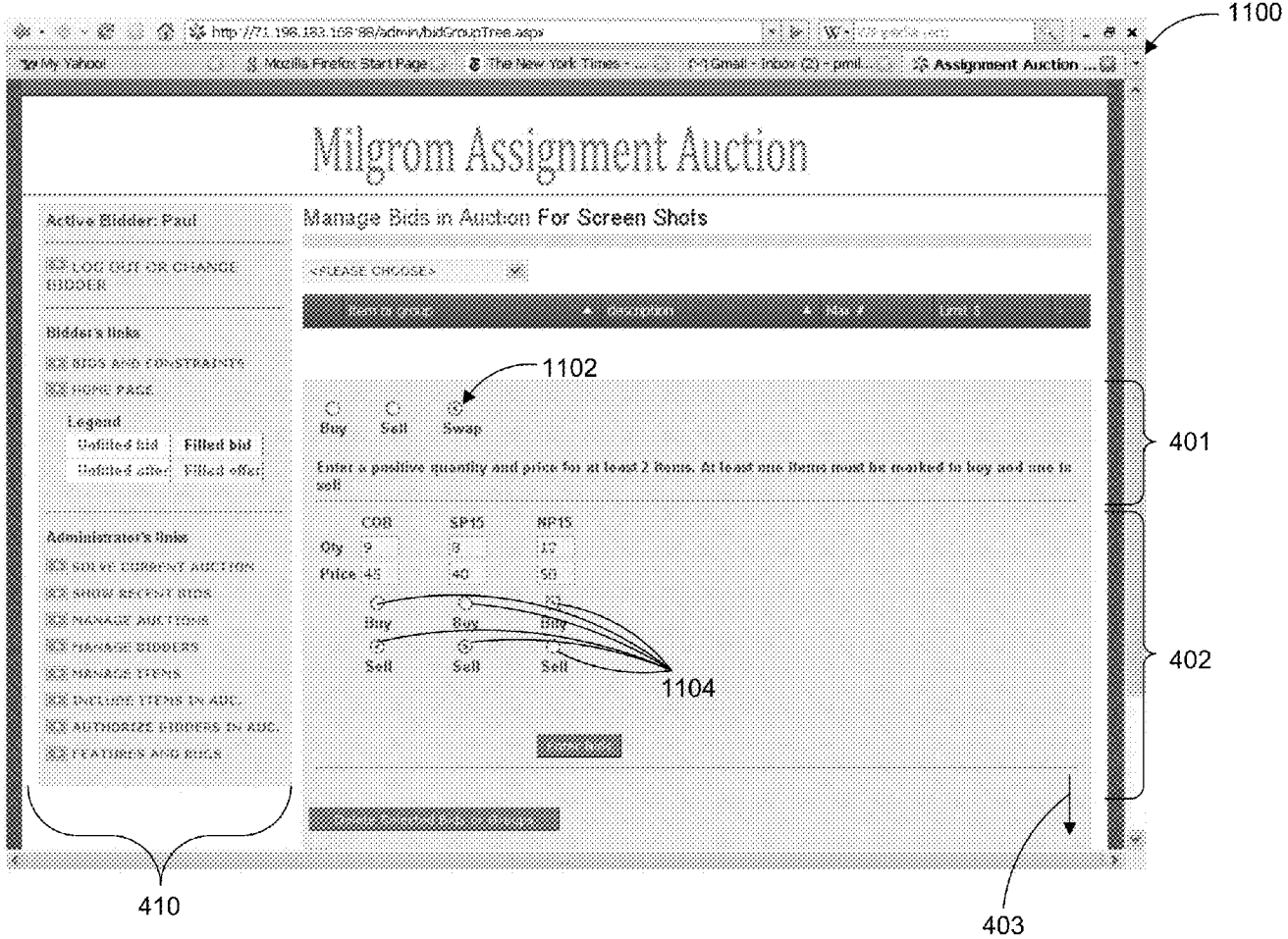

FIG. 11 shows an example embodiment of a user interface 1100 generated by the assignment exchange and auction system 100 receiving data from a bidder creating a bid to swap. In the example of FIG. 11 an input mechanism 1102, such as a radio button, included in the bid type portion 401 is accessed to identify that the bid is a swap type bid. The data entry portion 402 then receives data from a bidder indicating whether the bidder is buying or selling different types of items and also receives data describing a bid to buy or sell an item, such as data described above in conjunction with FIGS. 4 and 10. To receive data indicating whether a bidder is buying or selling an item, the data entry portion 402 displays a type selector 1104 associated with different items. For example, the data entry portion 402 displays a radio button, or other input mechanism, associated with a bid to buy and a radio button, or other input mechanism, associated with a bid to sell proximate to an identifier or other data associated with an item, allowing a bidder to identify whether the bid is a bid to sell or a bid to buy an item by accessing the appropriate radio button, or other input mechanism. In the example shown by FIG. 11, a buyer located in northern California enters a swap bid to swap power that the bidder owns at two locations, identified as SP15 and COB in the example in FIG. 11, from which transmission costs are high, for power from a third location, identified as NP15 in the example of FIG. 11, for which there are no transmission costs. In the example of FIG. 11, the bidder is buying a maximum of 12 units of power from NP15, selling a maximum of 8 units of power from SP15 and selling a maximum of 9 units of power from COB. In one embodiment, the assignment auction and exchange system 100 implements a swap bid by enforcing a constraint that total quantity of items assigned to the swap bid is zero; hence, in one embodiment the total amount of items purchased equals the total amount of items sold. In an alternate embodiment of a swap bid, the maximum net purchase of items and the maximum net sale of items are be unequal and set to non-zero values. An alternate embodiment enables bidders to modify a message concerning the substitution hierarchy by dragging and dropping a bid or a group of bids under another group indicator, which is taken to mean that the former bid or group is subject to the substitution constraints of the superior group.

Figure 12:
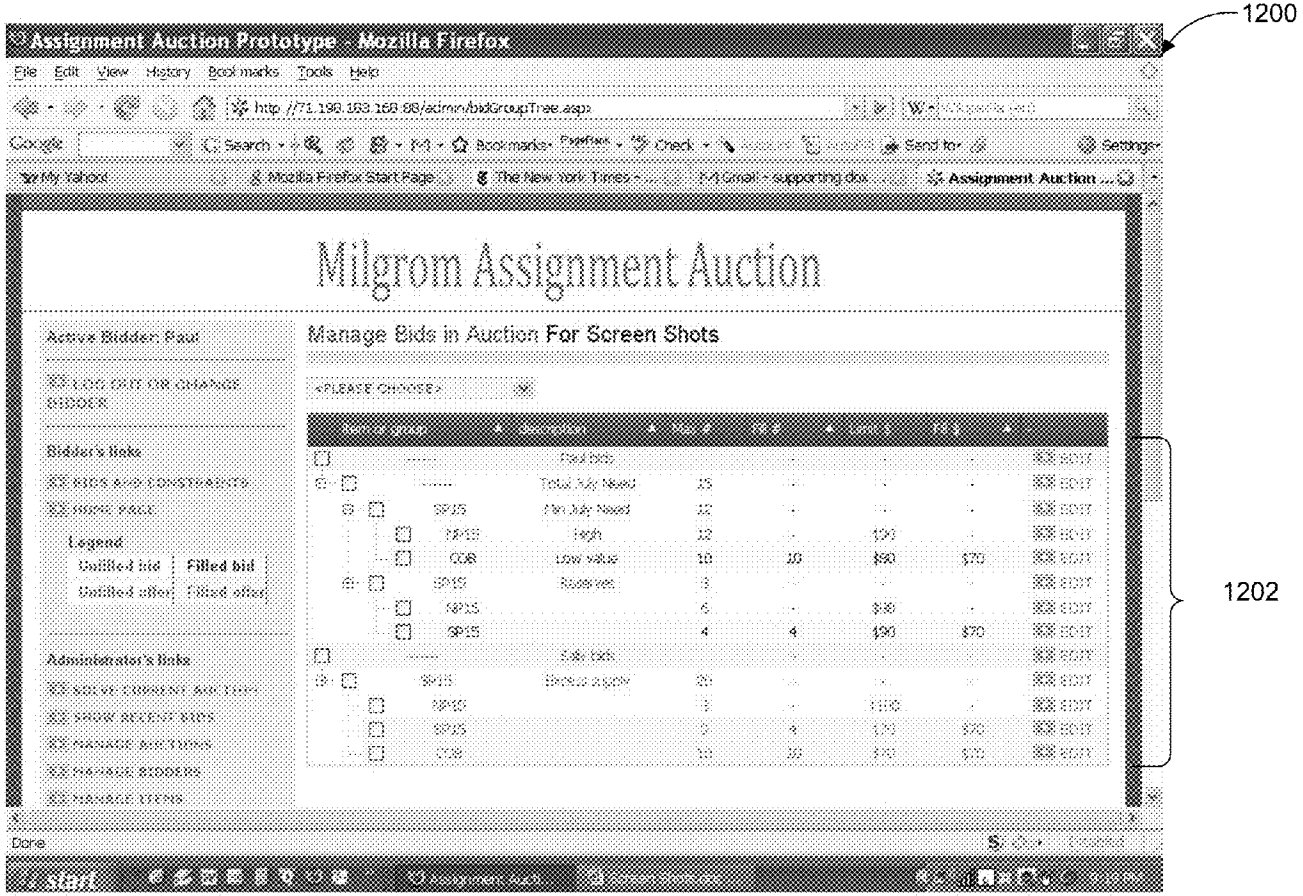
Figure 13:
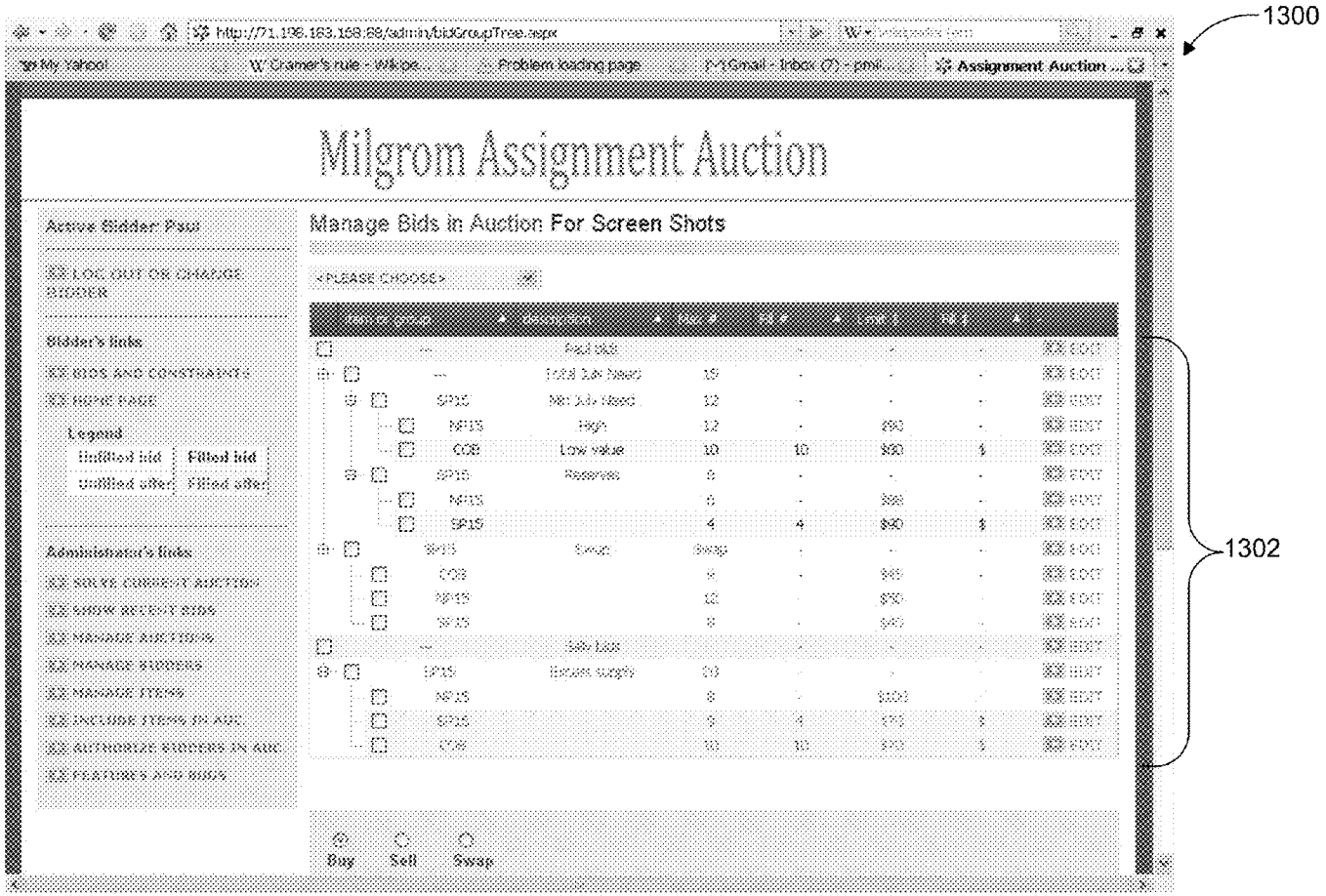

FIGS. 12 and 13 show examples of user interfaces 1200, 1300 for displaying results after bid entry and computation of auction or exchange results. User interface 1200 includes a bid presentation region 1202, while user interface 1300 includes a similar bid presentation region 1302, to display bids and bid groups used during the auction or exchange. In one embodiment, user interfaces 1200, 1300 are displayed to a system administrator or to an auctioneer, so the example user interfaces 1200, 1300 organize bids and bid groups according to the bidder placing the bid or bid group. In the examples of FIGS. 12, and 13, the example user interfaces 1200, 1300 depict bids received from two bidders, identified as Paul and Sally, and group the bids or bid groups based whether a bid or bid group was received from Paul or from Sally. In another embodiment where a user interface 1200, 1300 is presented to a particular bidder via a trading system 206, bid groups or bids placed by the particular bidder, rather than bids from multiple bidders, are displayed in the bid presentation region 1202, 1302.

In one embodiment, the bid presentation region 1202, 1302 visually differentiates different types of bids. In one embodiment, the bid presentation region 1202, 1302 color codes bids according to bid type, allowing a bidder to easily distinguish types of bids within a bid group. For example, bids to buy are shown using text having a first color and bids to sell are shown using text having a second color. In one embodiment, additional visual differentiation is used to indicate whether bids are filled or unfilled as a result of the auction or exchange. For example, a background region proximate to text of a bid that has been filled is displayed using a third color while a background region proximate to text of a bid that has not been filled is displayed using a fourth color. In other embodiments, visual indications of bid type and status other than color or used, such as use of different text fonts, use of different text styles or formats, use of graphical icons or use of other suitable visual indicators.

The example user interface 1300 illustrated by FIG. 13 also shows the results of a swap bid including both bids to buy and offers to sell. In one embodiment, the swap bid is visually differentiated from other types of bids. For example, a color scheme is applied to the swap bid to identify it, such as using a fifth color to display text of the swap bid. In one embodiment, a text indicator, such as "swap" is also displayed to identify the swap bid, as shown in FIG. 13 by the text "swap" in the column identified as "Max #." An indicator that a bid is a swap bid indicates that the total quantities purchased and sold in the swap bid are equal.

While FIGS. 4-13 describe examples of user interfaces allowing a bidder to communicate bids, constraints or other data from a bidder device 110 to a server 120, in one embodiment bidders communicate data files including structured data to the server 120 describing bids, constraints or other data. For example, bidders describe one or more bids using a markup language document, such as an extensible markup language (XML) document, where tags identify different components of a bid message, such as a bidder identifier, an item identifier, a maximum quantity associated with the item identifier and a price associated with the item identifier. The markup language document may also include additional tags identifying one or more constraints or additional data or attributes, such as those described above in conjunction with FIG. 2. In one embodiment, one or more markup language documents associated with bidder identifiers are stored by the server 120. Appendix A provides an example XML document describing configuration of an auction as well as describing bids for items in an auction. Appendix B provides an example of an XML schema specifying attributes used to configure an auction, place bids in an auction or identify constraints used in an auction.

The disclosed assignment auction and exchange system 100 beneficially achieves maximum value relative to the bids, determines market-clearing item prices, increases the accurate with which prices reflect relevant differences in cost and value to the bidders (including buyers, sellers, and swappers), determines integer solutions supported by market-clearing prices and allows quick and easy bidding.

The foregoing description of the embodiments of the present invention has been presented for the purposes of illustration and description. It is not intended to be exhaustive or to limit the present invention to the precise form disclosed. Many modifications and variations are possible in light of the above teaching. It is intended that the scope of the present invention be limited not by this detailed description, but rather by the claims of this application. As will be understood by those familiar with the art, the present invention may be embodied in other specific forms without departing from the spirit or essential characteristics thereof. Likewise, the particular naming and division of the modules, routines, features, attributes, methodologies and other aspects are not mandatory or significant, and the mechanisms that implement the present invention or its features may have different names, divisions and/or formats. Furthermore, as will be apparent to one of ordinary skill in the relevant art, the modules, routines, features, attributes, methodologies and other aspects of the present invention can be implemented as software, hardware, firmware or any combination of the three. Also, wherever a component, an example of which is a module, of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the present invention is in no way limited to implementation in any specific programming language, or for any specific operating system or environment. Accordingly, the disclosure of the present invention is intended to be illustrative, but not limiting, of the scope of the present invention, which is set forth in the following claims.

APPENDIX A

Appendix A provides an example XML document associated with an auction, illustrating the use of various XML tags to identify and differentiate between data used in configuring an auction. In the example of Appendix A, an auction id identified by the data specified in the <auction name> tag, and auction options are identified within the <auctionOptions> and </auctionOptions> tags. For example, the auction auctions in Appendix A identify a maximum of three sellers, specify the level of precision used in displaying prices, specifies tiebreaker rules used by the auction, minimum quantities for groups and price rules used during the auction. In addition to identifying auction configuration data, Appendix A provides examples of XML data identifying bidders as well as examples of bids placed by different bidders participating in the auction.

```
- <MaaXData>
- <header>
  <action>archive</action>
  <signature>abcxyz</signature>
  <revision>1.0</revision>
  <timestamp>11/18/2010 9:52:02 AM</timestamp>
    </header>
- <auction name="we_demo4" auctionId="4885" status="2"
created="11/8/2010 8:47:44 AM" auctionSolved="False">
- <auctionOptions>
  <auctionOption label="Maximum number of sellers" index="3"
textValue="" value="20" valueString="20" />
  <auctionOption label="Precision for prices (digits to right of decimal)"
index="12" textValue="" value="2" valueString="#.##" />
  <auctionOption label="Use bid descriptions" index="9" textValue=""
value="1" valueString="On" />
  <auctionOption label="Bidder Tiebreak rule" index="11"
textValue="" value="0" valueString="No Bidder TieBreak" />
  <auctionOption label="Item tiebreak rule" index="7" textValue=""
value="0" valueString="No Item Tiebreak" />
  <auctionOption label="Market" index="5" textValue="" value="0"
valueString="Forward auction" />
  <auctionOption label="Minimum Quantity" index="32" textValue=""
value="1" valueString="Use Min quantity for groups" />
  <auctionOption label="Price rule" index="4" textValue="" value="3"
valueString= "Pay as bid" />
    </auctionOptions>
- <bidderBindings>
  <bidderBinding name="Load10" mayBuy="true"
quota="1000000000" />
  <bidderBinding name="Load9" mayBuy="true" quota="1000000000"
/>
  <bidderBinding name="Load8" mayBuy="true" quota="1000000000"
/>
  <bidderBinding name="Load7" mayBuy="true" quota="1000000000"
/>
  <bidderBinding name="Load6" mayBuy="true" quota="1000000000"
/>
  <bidderBinding name="Load5" mayBuy="true" quota="1000000000"
/>
  <bidderBinding name="Load4" mayBuy="true" quota="1000000000"
/>
  <bidderBinding name="Load3" mayBuy="true" quota="1000000000"
/>
  <bidderBinding name="Load2" mayBuy="true" quota="1000000000"
/>
  <bidderBinding name="Load1" mayBuy="true" quota="1000000000"
/>
  <bidderBinding name="Generator" maySell="true"
quota="1000000000" />
  <bidderBinding name="Buyer 1" mayBuy="true" maySell="true"
quota="36000000000" />
  <bidderBinding name="steve" quota="1000000000" />
    </bidderBindings>
- <itemBindings>
  <itemBinding name="Pwr2011_12M" />
  <itemBinding name="Pwr2011_11M" />
  <itemBinding name="Pwr2011_10M" />
```

-continued

```
  <itemBinding name="Pwr2011_09M" />
  <itemBinding name="Pwr2011_08M" />
  <itemBinding name="Pwr2011_07M" />
  <itemBinding name="Pwr2011_06M" />
  <itemBinding name="Pwr2011_05M" />
  <itemBinding name="Pwr2011_04M" />
  <itemBinding name="Pwr2011_03M" />
  <itemBinding name="Pwr2011_02M" />
  <itemBinding name="Pwr2011_01M" />
  <itemBinding name="Pwr2011_12" />
  <itemBinding name="Pwr2011_11" />
  <itemBinding name="Pwr2011_10" />
  <itemBinding name="Pwr2011_09" />
  <itemBinding name="Pwr2011_08" />
  <itemBinding name="Pwr2011_07" />
  <itemBinding name="Pwr2011_06" />
  <itemBinding name="Pwr2011_05" />
  <itemBinding name="Pwr2011_04" />
  <itemBinding name="Pwr2011_03" />
  <itemBinding name="Pwr2011_02" />
  <itemBinding name="Pwr2011_01" />
    </itemBindings>
- <bids>
- <bidderRoot bidderName="Load10" description="Load10's bids">
- <substitutionGroup buySell="buy" qty="12" minQty="12"
description="All or none fill">
  <bid itemName="Pwr2011_08" buySell="buy" price="53.1" qty="12"
/>
    </substitutionGroup>
    </bidderRoot>
- <bidderRoot bidderName="Load8" description="Load8's bids">
- <substitutionGroup buySell="buy" qty="7" description="Group 16">
  <bid itemName="Pwr2011_12" buySell="buy" price="52" qty="7" />
  <bid iternName="Pwr2011_12M" buySell="buy" price="51" qty="7"
/>
    </substitutionGroup>
    </bidderRoot>
- <bidderRoot bidderName="Load7" description="Load7's bids">
  <bid itemName="Pwr2011_04" buySell="buy" price="52" qty="1" />
  <bid itemName="Pwr2011_06" buySell="buy" price="52" qty="1" />
  <bid itemName="Pwr2011_05" buySell="buy" price="52" qty="1" />
    </bidderRoot>
- <bidderRoot bidderName="Load5" description="Load5's bids">
  <bid itemName="Pwr2011_09" buySell="buy" price="51.23" qty="5"
/>
  <bid itemName="Pwr2011_10" buySell="buy" price="51.27" qty="5"
/>
  <bid itemName="Pwr2011_11" buySell="buy" price="52.23" qty="5"
/>
  <bid itemName="Pwr2011_12" buySell="buy" price="53.42" qty="5"
/>
    </bidderRoot>
- <bidderRoot bidderName="Load6" description="Load6's bids">
- <substitutionGroup buySell="buy" qty="30" minQty="30"
description="All or none fill">
  <bid itemName="Pwr2011_07" buySell="buy" price="52.32"
qty="10" />
  <bid itemName="Pwr2011_08" buySell="buy" price="53.27"
qty="10" />
  <bid itemName="Pwr2011_09" buySell="buy" price="49.23"
qty="10" />
    </substitutionGroup>
    </bidderRoot>
- <bidderRoot bidderName="Load4" description="Load4's bids">
- <substitutionGroup buySell="buy" qty="7" description="September
margin or not">
  <bid itemName="Pwr2011_09M" buySell="buy" price="52.15"
qty="7" />
  <bid itemName="Pwr2011_09" buySell="buy" price="52.92" qty="7"
description="Non marginable at a premium" />
    </substitutionGroup>
  <bid itemName="Pwr2011_10" buySell="buy" price="51.27" qty="8"
/>
  <bid itemName="Pwr2011_11" buySell="buy" price="51.23" qty="8"
/>
  <bid itemName="Pwr2011_12" buySell="buy" price="52.32" qty="7"
/>
    </bidderRoot>
- <bidderRoot bidderName="Load3" description="Load3's bids">
```

-continued

```
- <substitutionGroup buySell="buy" qty="36" minQty="36"
description="All or none fill">
   <bid itemName="Pwr2011_01" buySell="buy" price="53.32" qty="9"
/>
   <bid itemName="Pwr2011_02" buySell="buy" price="53.27" qty="9"
/>
   <bid itemName="Pwr2011_03" buySell="buy" price="53.23" qty="9"
/>
   <bid itemName="Pwr2011_04" buySell="buy" price="52" qty="9" />
      </substitutionGroup>
      </bidderRoot>
- <bidderRoot bidderName="Load2" description="Load2's bids">
   <bid itemName="Pwr2011_01M" buySell="buy" price="47.92"
qty="5" />
      </bidderRoot>
- <bidderRoot bidderName="Load1" description="Load1's bids">
   <bid itemName="Pwr2011_11" buySell="buy" price="51.42" qty="3"
/>
      </bidderRoot>
- <bidderRoot bidderName="Generator" description="Generator's
offers">
- <substitutionGroup buySell="sell" qty="8" description="Non-
marginable substitutes for marginable at $1 premium">
   <bid itemName="Pwr2011_12M" buySell="sell" price="49.1"
qty="8" />
   <bid itemName="Pwr2011_12" buySell="sell" price="50.15" qty="8"
/>
      </substitutionGroup>
- <substitutionGroup buySell="sell" qty="8" description="Non-
marginable substitutes for marginable at $1 premium">
   <bid itemName="Pwr2011_11M" buySell="sell" price="49.15"
qty="8"/>
   <bid itemName="Pwr2011_11" buySell="sell" price="50.1" qty="8"
/>
      </substitutionGroup>
- <substitutionGroup buySell="sell" qty="10" description="Non-
marginable substitutes for marginable at $1 premium">
   <bid itemName="Pwr2011_10M" buySell="sell" price="49.75"
qty="10" />
   <bid itemName="Pwr2011_10" buySell="sell" price="50.7" qty="10"
/>
      </substitutionGroup>
- <substitutionGroup buySell="sell" qty="12" description="Non-
marginable substitutes for marginable at $1 premium">
   <bid itemName="Pwr2011_08M" buySell="sell" price="49.7"
qty="12" />
   <bid itemName="Pwr2011_08" buySell="sell" price="50.75"
qty="12" />
      </substitutionGroup>
- <substitutionGroup buySell="sell" qty="12" description="Non-
marginable substitutes for marginable at $1 premium">
   <bid itemName="Pwr2011_09M" buySell="sell" price="50.3"
qty="12" />
   <bid itemName="Pwr2011_09" buySell="sell" price="51.34"
qty="12" />
      </substitutionGroup>
      </bidderRoot>
      </bids>
      </auction>
      </MaaXData>
```

APPENDIX B

Appendix B provides an example XML schema identifying various tags used to identify data associated with auction configuration, bidders, groups and bids from bidders. While Appendix B shows one embodiment of an XML schema for configuring and/or implementing an assignment auction, in other embodiments, an XML schema including different and/or additional components may be used -continued

```
<?xml version="1.0"
   encoding="utf-8"?>
<xs:schema
   attributeFormDefault ="qualified"
   elementFormDefault="qualified"
   xmlns:xs="http://www.w3.org/2001/XMLScheman">
   <xs:attributeGroup name="mayBuySell" >
      <xs:attribute name="mayBuy" type="xs:boolean" use="optional"
default="false"/>
      <xs:attribute name="maySell" type="xs:boolean" use="optional"
default="false"/>
      <xs:attribute name="maySwap" type="xs:boolean" use="optional"
default="false"/>
   </xs:attributeGroup>
   <xs:attributeGroup name="bidAttributes">
      <xs:attribute name="itemName" use="optional" type="xs:string"/>
      <xs:attribute name="buySell" use="optional" type="xs:string"/>
      <xs:attribute name="price" use="optional" type="xs:double" />
      <xs:attribute name="qty" use="optional" type="xs:double" />
      <xs:attribute name="minQty" use="optional" type="xs:double" />
      <xs:attribute name="fillQty" use="optional" type="xs:double" />
      <xs:attribute name="fillPrice" use="optional" type="xs:double" />
      <xs:attribute name="description" use="optional" type="xs:string"/>
      <xs:attribute name="effectiveness" use="optional"
type="xs:double" />
      <xs:attribute name="fixedCost" use="optional" type="xs:double" />
      <xs:attribute name="contingentBid" use="optional"
type="xs:integer" />
      <xs:attribute name="logicalQty" use="optional" type="xs:double"
/>
      <xs:attribute name="logicalMinQty" use="optional"
type="xs:double" />
      <xs:attribute name="marketBid" use="optional" type="xs:boolean"
/>
      <xs:attribute name="nodeType" use="optional"/>
      <xs:attribute name="parentNode" use="optional" type="xs:integer"
/>
      <xs:attribute name="bidNodeId" use="optional" type="xs:integer"
/>
   </xs:attributeGroup>
   <xs:attributeGroup name="groupAttributes">
      <xs:attribute name="budget" use="optional" type="xs:float" />
      <xs:attribute name="quota" use="optional" type="xs:double" />
      <xs:attribute name="buySell" use="optional" type="xs:string"/>
      <xs:attribute name="price" use="optional" type="xs:double" />
      <xs:attribute name="qty" use="optional" type="xs:double" />
      <xs:attribute name="minQty" use="optional" type="xs:double" />
      <xs:attribute name="fillQty" use="optional" type="xs:double" />
      <xs:attribute name="fillPrice" use="optional" type="xs:double" />
      <xs:attribute name="description" use="optional" type="xs:string"/>
      <xs:attribute name="effectiveness" use="optional"
type="xs:double" />
      <xs:attribute name="fixedCost" use="optional" type="xs:double" />
      <xs:attribute name="contingentBid" use="optional"
type="xs:integer" />
      <xs:attribute name="logicalQty" use="optional" type="xs:double"
/>
      <xs:attribute name="logicalMinQty" use="optional"
type="xs:double" />
      <xs:attribute name="marketBid" use="optional" type="xs:boolean"
/>
      <xs:attribute name="nodeType" use="optional" />
      <xs:attribute name="parentNode" use="optional" type="xs:integer"
/>
      <xs:attribute name="bidNodeId" use="optional" type="xs:integer"
/>
   </xs:attributeGroup>
   <!-- definition of simple elements -->
   <xs:element name="signature" type="xs:string">
   </xs:element>
   <xs:element name="timestamp" type="xs:string">
   </xs:element>
   <xs:element name="action" type="xs:string">
   </xs:element>
   <xs:element name="version" type="xs:float">
   </xs:element>
   <xs:element name="itemBinding" >
      <xs:complexType>
         <xs:attribute name="name" use="required" type="xs:string"/>
      </xs:complexType>
   </xs:element>
   <xs:complexType name="bidType">
```

-continued

```
      <xs:sequence>
        <xs:element ref="substitutionGroup" maxOccurs="unbounded"
minOccurs="0" />
        <xs:element name="bid" maxOccurs="unbounded"
minOccurs="0"/>
      </xs:sequence>
      <xs:attributeGroup ref="bidAttributes" />
    </xs:complexType>
    <xs:element name="bid" type="bidType"></xs:element>
    <xs:complexType name="subType">
      <xs:sequence>
        <xs:element ref="substitutionGroup" maxOccurs="unbounded"
minOccurs="0" />
        <xs:element ref="bid" maxOccurs="unbounded" minOccurs="0"
/>
      </xs:sequence>
      <xs:attributeGroup ref="groupAttributes" />
    </xs:complexType>
    <xs:element name="substitutionGroup">
      <xs:complexType>
        <xs:sequence>
          <xs:element name="substitutionGroup" type="subType"
minOccurs="0" maxOccurs="unbounded"/>
          <xs:element ref="bid" maxOccurs="unbounded"
minOccurs="0" />
        </xs:sequence>
        <xs:attributeGroup ref="groupAttributes" />
      </xs:complexType>
    </xs:element>
    <xs:element name="logicalGroup">
      <xs:complexType>
        <xs:sequence maxOccurs="10000" minOccurs="0">
          <xs:element ref="substitutionGroup"></xs:element>
          <xs:element name="bid" block="#all" >
            <xs:complexType>
              <xs:sequence maxOccurs="10000" minOccurs="0">
                <xs:element ref="substitutionGroup"></xs:element>
                <xs:element name="bid" block="#all" >
                  <xs:complexType>
                    <xs:sequence maxOccurs="10000"
minOccurs="0">
                      <xs:element
ref="substitutionGroup"></xs:element>
                      <xs:element name="bid" block="#all" >
                        <xs:complexType>
                          <xs:sequence
maxOccurs="10000"minOccurs="0">
<xs:element ref="substitutionGroup"></xs:element>
<xs:element name="bid" block="#all" >
<xs:complexType>
<xs:sequence maxOccurs="10000" minOccurs="0">
<xs:element ref="substitutionGroup"></xs:element>
<xs:element name="bid" block="#all" >
<xs:complexType>
<xs:attributeGroup ref="bidAttributes" />
</xs:complexType>
</xs:element>
                          </xs:sequence>
<xs:attributeGroup ref="bidAttributes" />
                        </xs:complexType>
                      </xs:element>
                    </xs:sequence>
                    <xs:attributeGroup ref="bidAttributes" />
                  </xs:complexType>
                </xs:element>
              </xs:sequence>
              <xs:attributeGroup ref="bidAttributes" />
            </xs:complexType>
          </xs:element>
        </xs:sequence>
        <xs:attributeGroup ref="bidAttributes" />
      </xs:complexType>
    </xs:element>
    </xs:sequence>
    <xs:attribute name="bidderName" use="required"
type="xs:string"/>
    <xs:attribute name="budget" use="optional" type="xs:double" />
    <xs:attribute name="quota" use="optional" type="xs:double" />
    <xs:attribute name="description" use="optional" type="xs:string"/>
```

-continued

```
    <xs:attribute name="parentNode" use="optional" type="xs:integer"
/>
    <xs:attribute name="bidNodeId" use="optional" type="xs:integer"
/>
  </xs:complexType>
</xs:element>
<xs:element name="swapGroup">
  <xs:complexType>
    <xs:sequence maxOccurs="unbounded" minOccurs="0">
      <xs:element name="bid" type="bidType" />
    </xs:sequence>
    <xs:attributeGroup ref="groupAttributes" />
  </xs:complexType>
</xs:element>
<xs:element name="demandCurve">
  <xs:complexType>
    <xs:sequence maxOccurs="unbounded" minOccurs="0">
      <xs:element name="bid" block="#all">
        <xs:complexType>
          <xs:attributeGroup ref="bidAttributes" />
        </xs:complexType>
      </xs:element>
    </xs:sequence>
    <xs:attributeGroup ref="groupAttributes" />
  </xs:complexType>
</xs:element>
<xs:element name="singleFillGroup">
  <xs:complexType>
    <xs:sequence maxOccurs="unbounded" minOccurs="0">
      <xs:element name="bid" block="#all" >
        <xs:complexType>
          <xs:attributeGroup ref="bidAttributes" />
        </xs:complexType>
      </xs:element>
    </xs:sequence>
    <xs:attributeGroup ref="groupAttributes"/>
  </xs:complexType>
</xs:element>
<xs:element name="bidderRoot">
  <xs:complexType>
    <xs:sequence>
      <xs:element ref="substitutionGroup" maxOccurs="unbounded"
minOccurs="0" />
      <xs:element ref="bid" maxOccurs="unbounded" minOccurs="0"
/>
      <xs:element ref="swapGroup" maxOccurs="unbounded"
minOccurs="0" />
      <xs:element ref="logicalGroup" maxOccurs="unbounded"
minOccurs="0"/>
      <xs:element ref="demandCurve" maxOccurs="unbounded"
minOccurs="0" />
      <xs:element ref="singleFillGroup" maxOccurs="unbounded"
minOccurs="0" />
    </xs:sequence>
    <xs:attribute name="bidderName" use="required"
type="xs:string"/>
    <xs:attribute name="budget" use="optional" type="xs:double" />
    <xs:attribute name="quota" use="optional" type="xs:double" />
    <xs:attribute name="description" use="optional" type="xs:string"
/>
    <xs:attribute name="parentNode" use="optional" type="xs:integer"
/>
    <xs:attribute name="bidNodeId" use="optional" type="xs:integer"
/>
  </xs:complexType>
</xs:element>
<xs:element name="bidder" >
  <xs:complexType>
  <xs:attribute name="name" use="required" type="xs:string"/>
  <xs:attributeGroup ref="mayBuySell"/>
  </xs:complexType>
</xs:element>
<xs:element name="item" type="xs:string">
</xs:element>
<!-- definition of complex elements -->
<xs:element name="header">
  <xs:complexType>
    <xs:all>
      <xs:element ref="action"/>
```

-continued

```
        <xs:element ref="signature"/>
        <xs:element ref="version" minOccurs="1" />
        <xs:element ref="timestamp"/>
      </xs:all>
    </xs:complexType>
  </xs:element>
  <xs:element name="bidders">
    <xs:complexType>
      <xs:sequence>
        <xs:element ref="bidder" maxOccurs="10000" minOccurs="0"/>
      </xs:sequence>
    </xs:complexType>
  </xs:element>
  <xs:element name="items">
    <xs:complexType>
      <xs:sequence>
        <xs:element ref="item" maxOccurs="10000" minOccurs="0"/>
      </xs:sequence>
    </xs:complexType>
  </xs:element>
  <xs:element name="bidderBindings">
    <xs:complexType>
      <xs:sequence>
        <xs:element name="bidderBinding" maxOccurs="1000"
minOccurs="0" >
          <xs:complexType>
            <xs:attribute name="name" use="required" />
            <xs:attribute name="mayBuy" type="xs:boolean"
default="false"/>
            <xs:attribute name="maySell" type="xs:boolean"
default="false"/>
            <xs:attribute name="maySwap" type="xs:boolean"
default="false"/>
          </xs:complexType>
        </xs:element>
      </xs:sequence>
    </xs:complexType>
  </xs:element>
  <xs:element name="itemBindings">
    <xs:complexType>
      <xs:sequence>
        <xs:element ref="itemBinding" maxOccurs="1000"
minOccurs="0"/>
      </xs:sequence>
    </xs:complexType>
  </xs:element>
  <xs:element name="bids">
    <xs:complexType>
      <xs:sequence>
        <xs:element ref="bidderRoot" maxOccurs="100000"
minOccurs="0"/>
      </xs:sequence>
    </xs:complexType>
  </xs:element>
  <xs:element name="auction">
    <xs:complexType>
      <xs:all>
        <xs:element name="auctionOptions">
          <xs:complexType>
            <xs:sequence>
              <xs:element name="auctionOption" maxOccurs="150"
minOccurs="0">
                <xs:complexType>
                  <xs:attribute name="label" type="xs:string" />
                  <xs:attribute name="index" type="xs:integer" />
                  <xs:attribute name="textValue" type="xs:string" />
                  <xs:attribute name="value" type="xs:integer" />
                  <xs:attribute name="valueString" type="xs:string" />
                </xs:complexType>
              </xs:element>
            </xs:sequence>
          </xs:complexType>
        </xs:element>
        <xs:element ref="bidderBindings" />
        <xs:element ref="itemBindings" />
        <xs:element ref="bids" />
      </xs:all>
    <xs:attribute name="name"use="required" />
    <xs:attribute name="auctionId" use="required" />
    <xs:attribute name="status" use="required" />
    <xs:attribute name="created" use="required" />
    <xs:attribute name="auctionSolved" use="required"/>
    </xs:complexType>
  </xs:element>
  <xs:element name="MaaXData">
    <xs:complexType>
      <xs:all>
        <xs:element ref="header" minOccurs="1" />
        <xs:element ref="bidders" minOccurs="0" />
        <xs:element ref="items" minOccurs="0" />
        <xs:element ref="auction" minOccurs="0" />
      </xs:all>
    </xs:complexType>
  </xs:element>
</xs:schema>
```

What is claimed is:

1. An apparatus for allocating one or more items in an auction and exchange, comprising:

a processor; and a tangible computer readable storage medium including instructions that, when executed by the processor cause the processor to:

receive data identifying the one or more items and identifying one or more bidder identifiers, a bidder identifier associated with a bidder;

receive bidder preference data associated with a first bidder identifier;

receive one or more first bid messages from a first bidder device associated with a first bidder having a first bidder identifier, a first bid message including the first bidder identifier, an item identifier, a maximum quantity associated with the item identifier and the first bidder identifier and a first price associated with the item identifier;

receive one or more second bid messages from a second bidder device associated with a second bidder having a second bidder identifier, a second bid message including the second bidder identifier, the item identifier, a maximum quantity associated with the item identifier and the second bidder identifier and a second price associated with the item identifier;

determine prices associated with the one or more items using one or more stored pricing rules;

determine an allocation of items between the first bidder and the second bidder, the allocation maximizing a total difference between one or more maximum prices associated with bid messages to buy one or more items and one or more minimum prices of bids to sell one or more items; and determine prices associated with the one or more items using one or more stored pricing rules.

2. The apparatus of claim 1 wherein the first bid message further includes a constraint affecting allocation of one or more items to the first bidder and wherein the allocation maximizes the total difference between one or more maximum prices associated with bid messages to buy one or more items and one or more minimum prices of bids to sell one or more items subject to the constraint.

3. The apparatus of claim 2, wherein the constraint comprises a budget identifying a maximum total price for a quantity associated with the item identifier

4. The apparatus of claim 3, wherein the bidder preference data includes a credit limit associated with the first bidder.

5. The apparatus of claim 4, wherein the allocation maximizes the total difference between one or more maximum prices associated with bid messages to buy one or more items and one or more minimum prices of bids to sell one or more items subject to the minimum of the budget and the credit limit.

6. The apparatus of claim 2, wherein the constraint comprises a quota identifying a maximum quantity associated with the item identifier.

7. The apparatus of claim 2, wherein the constraint comprises a fixed cost associated with a bid group including one or more bid messages.

8. The apparatus of claim 7, wherein determining the allocation of items between the first bidder and the second bidder:

determines a total bid group difference between one or more maximum prices associated with bid messages to buy one or more items included in the bid group and one or more minimum prices of bids to sell one or more items included in the bid group, and allocates items to the first bidder responsive to the total bid group difference equaling or exceeding the fixed cost.

9. The apparatus of claim 1, wherein the first bid message further includes an effectiveness coefficient associated with the item identifier.

10. The apparatus of claim 1, wherein the one or more first bid messages include a swap bid message, the swap bid comprising a linked group of a bid message to buy and a bid message to sell in which a maximum quantity included in the bid message to buy and a maximum quantity included in the bid message to sell are equal.

11. The apparatus of claim 1, wherein the first bid message comprises a markup language document.

12. The apparatus of claim 11, wherein the markup language document comprises an extensible markup language (XML) document.

13. The apparatus of claim 1, further comprising:

a communication unit coupled to the processor and to the tangible computer readable storage medium, the communication unit transmitting a first message identifying the allocation of items to the first bidder to the first bidder device.

14. The apparatus of claim 13, wherein data included first message is determined by the bidder preference data.

15. The apparatus of claim 14, wherein the first message includes a hierarchical description of one or more received bid messages.

16. The apparatus of claim 13, wherein the bidder preference data identifies a minimum amount of data included in the first message.

17. The apparatus of claim 1, wherein the bidder preference data identifies a format associated with the first message.

18. A system for allocating one or more items in an auction and exchange, comprising:

a first bidder device associated with a first bidder;

a second bidder device associated with a second bidder;

a server coupled to the first bidder device and to the second bidder device, the server for:

receiving data identifying the one or more items, a first bidder identifier associated with the first bidder and a second bidder identifier associated with the second bidder;

receiving bidder preference data associated the first bidder;

receiving one or more first bid messages from the first bidder device, a first bid message including the first bidder identifier, an item identifier, a maximum quantity associated with the item identifier and the first bidder identifier and a first price associated with the item identifier;

receiving one or more second bid messages from the second bidder device, a second bid message including the second bidder identifier, the item identifier, a maximum quantity associated with the item identifier and the second bidder identifier and a second price associated with the item identifier;

determining prices associated with the one or more items using one or more stored pricing rules; and determining an allocation of items between the first bidder and the second bidder, the allocation maximizing a total difference between one or more maximum prices associated with bid messages to buy one or more items and one or more minimum prices of bids to sell one or more items.

19. The system of claim 18, wherein the server is further configured to transmit a first message identifying the allocation of items to the first bidder to the first bidder device.

20. The system of claim 19, wherein the bidder preference data identifies a format associated with the first message and identifies data included in the first message.

21. The apparatus of claim 20, wherein the first message includes a hierarchical description of one or more received bid messages.

22. The system of claim 18, wherein the first bid message further includes a constraint affecting allocation of one or more items to the first bidder and wherein the allocation maximizes the total difference between one or more maximum prices associated with bid messages to buy one or more items and one or more minimum prices of bids to sell one or more items subject to the constraint.

23. The system of claim 22, wherein the constraint comprises a budget identifying a maximum of a product of maximum quantity and the first price.

24. The system of claim 23, wherein the bidder preference data includes a credit limit associated with the first bidder.

25. The system of claim 24, wherein the allocation maximizes the total difference between one or more maximum prices associated with bid messages to buy one or more items and one or more minimum prices of bids to sell one or more items subject to the minimum of the budget and the credit limit.

26. The system of claim 18, wherein the allocation of items between the first bidder and the second bidder determines allocation of the item between the first bidder and the second bidder using a first priority score associated with the first bidder and a second priority score associated with the second bidder responsive to a first difference between a maximum item price associated with the first bidder and a minimum item price associated with the first bidder equaling a second difference between a maximum item price associated with the second bidder and a minimum item price associated with the second bidder.

27. The system of claim 18, wherein the first bid message comprises a markup language document.

28. The system of claim 27, wherein the markup language document comprises an extensible markup language (XML) document.

29. A computer-implemented method for allocating one or more items in an auction and exchange, comprising:

receiving, at a server, data identifying the one or more items and identifying one or more bidder identifiers, a bidder identifier associated with a bidder;

receiving, at the server, bidder preference data associated with a first bidder identifier;

receiving, at the server, one or more first bid messages from a first bidder device associated with a first bidder having a first bidder identifier, a first bid message including the first bidder identifier, an item identifier, a maximum quantity associated with the item identifier and the first bidder identifier and a first price associated with the item identifier;

receiving, at the server, one or more second bid messages from a second bidder device associated with a second bidder having a second bidder identifier, a second bid message including the second bidder identifier, the item identifier, a maximum quantity associated with the item identifier and the second bidder identifier and a second price associated with the item identifier;

determining, at the server, prices associated with the one or more items using one or more stored pricing rules; and determining, at the server, an allocation of items between the first bidder and the second bidder, the allocation maximizing a total difference between one or more maximum prices associated with bid messages to buy one or more items and one or more minimum prices of bids to sell one or more items.

30. The method of claim 29, wherein receiving, at the server, one or more first bid messages from the first bidder device comprises:

transmitting a bidding agent to the first bidder device, the bidding agent associated with the first bidder identifier and is private to the first bidder; and receiving, at the server, a bid message including a bid from the first bidder and one or more false bids from the bidding agent, the bidding agent storing data to the bidder device distinguishing the bid form the first bidder and the one or more false bids.

31. The method of claim 30, wherein determining, at the server, the allocation of items between the first bidder and the second bidder uses the bid from the first bidder and the one or more false bids from the bidding agent.

32. The method of claim 31, wherein determining, at the server, the allocation of items between the first bidder and the second bidder further comprises:

transmitting an avowal request from the server to the first bidder device, the avowal request to determine whether a bid used in the allocation is a false bid from the bidding agent; and responsive to receiving, at the server, data from the server indicating the bid used in the allocation is the false bid from the bidding agent, removing the bid used in the allocation and determining a second allocation of items between the first bidder and the second bidder.

33. The method of claim 32, wherein determining, at the server, the allocation of items between the first bidder and the second bidder further comprises:

transmitting data from the server to the first bidder device identifying the allocation of items to the first bidder and initiating removal of the bidding agent from the first bidder device.

* * * * *